US007766738B2

(12) United States Patent
Ogiwara

(10) Patent No.: US 7,766,738 B2
(45) **Date of Patent: *Aug. 3, 2010**

(54) GAMING MACHINE OF THE TYPE WHEREIN A LARGE NUMBER OF PLAYERS PARTICIPATE IN GAME

(75) Inventor: Takahiro Ogiwara, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 183 days.

This patent is subject to a terminal disclaimer.

(21) Appl. No.: 11/401,924

(22) Filed: Apr. 12, 2006
(Under 37 CFR 1.47)

(65) Prior Publication Data

US 2007/0072669 A1 Mar. 29, 2007

(30) Foreign Application Priority Data

Apr. 13, 2005 (JP) ..... P2005-116140

(51) Int. Cl.
*A63F 9/24* (2006.01)

(52) U.S. Cl. ..... 463/16; 463/17; 463/20; 463/26

(58) Field of Classification Search ..... 463/16, 463/17, 20, 26
See application file for complete search history.

(56) References Cited

U.S. PATENT DOCUMENTS 5,775,993 A * 7/1998 Fentz et al. ..... 463/17
6,017,032 A * 1/2000 Grippo et al. ..... 273/138.1
6,033,307 A * 3/2000 Vancura ..... 463/20
6,077,162 A 6/2000 Weiss
6,887,154 B1 * 5/2005 Luciano et al. ..... 463/26
7,465,226 B2 * 12/2008 Ikeya et al. ..... 463/16
2004/0159590 A1 * 8/2004 Mothwurf ..... 209/551
2006/0163806 A1 * 7/2006 Toyoda ..... 273/142 R

FOREIGN PATENT DOCUMENTS

| | | |
|---|---|---|
| JP | 2001-161888 | 6/2001 |
| NZ | 506530 | 5/2001 |
| RU | 2106691 C1 | 3/1998 |
| WO | WO 01/83062 A1 | 11/2001 |

* cited by examiner

*Primary Examiner*—Scott Jones
*Assistant Examiner*—Omkar Deodhar
(74) *Attorney, Agent, or Firm*—Oblon, Spivak, McClelland, Maier & Neustadt, L.L.P.

(57) ABSTRACT

A gaming machine includes: a plurality of game terminals each including an operation section for accepting operation of a player, an acceptance unit for accepting game medium, and an image display unit for displaying a predetermined image; a plurality of cumulative storage units for storing a predetermined value of the game medium; a game control unit for controlling a game based on a base game or a bonus game; a first lottery unit for performing a lottery as to whether or not the bonus game is generated for each of the plurality of game terminals; a second lottery unit for performing a lottery as to whether or not game medium are paid out for each game terminal when the bonus game is generated; and a cumulative game medium payout unit for paying out the game medium to the determined game terminal.

10 Claims, 21 Drawing Sheets

FIG. 8

50

| RANDOM NUMBER RANGE | SYMBOL | | LOTTERY RESULT |
|---|---|---|---|
| | FIRST | SECOND | |
| 0-3 | CHANCE | CHANCE | WIN OF RANK-UP JP |
| 4-7 | JOKER | CHANCE | WIN OF RANK-UP JP |
| 8 | CHANCE | JOKER | WIN OF RANK-UP JP |
| 9-12 | MEGA | MEGA | WIN OF JP OF MEGA |
| 13-16 | JOKER | MEGA | WIN OF JP OF MEGA |
| 17 | MEGA | JOKER | WIN OF JP OF MEGA |
| 18-37 | MAJOR | MAJOR | WIN OF JP OF MAJOR |
| 38-57 | JOKER | MAJOR | WIN OF JP OF MAJOR |
| 58-67 | MAJOR | JOKER | WIN OF JP OF MAJOR |
| 68-2707 | MINI | MINI | WIN OF JP OF MINI |
| 2708-5347 | JOKER | MINI | WIN OF JP OF MINI |
| 5348-6667 | MINI | JOKER | WIN OF JP OF MINI |
| 6668-7267 | CHANCE | MEGA | BLANK |
| 7268-8267 | CHANCE | MAJOR | BLANK |
| 8268-9267 | CHANCE | MINI | BLANK |
| 9268-9867 | MEGA | CHANCE | BLANK |
| 9868-10867 | MAJOR | CHANCE | BLANK |
| 10868-11867 | MINI | CHANCE | BLANK |
| 11868-12867 | MEGA | MAJOR | BLANK |
| 12868-13267 | MAJOR | MEGA | BLANK |
| 13268-14267 | MEGA | MINI | BLANK |
| 14268-14667 | MINI | MEGA | BLANK |
| 14668-20667 | MAJOR | MINI | BLANK |
| 20668-26667 | MINI | MAJOR | BLANK |
| 26668-8388607 | - | - | NO BONUS GAME GENERATED |

(RANDOM NUMBER RANGE: 0-8388607)

GAMING MACHINE OF THE TYPE WHEREIN A LARGE NUMBER OF PLAYERS PARTICIPATE IN GAME

CROSS-REFERENCE TO THE RELATED APPLICATION(S)

This application is based upon and claims a priority from prior Japanese Patent Applications No. 2005-116140 filed on Apr. 13, 2005, the entire contents of which are incorporated herein by reference.

BACKGROUND OF THE INVENTION

1. Field of the Invention

This invention relates to a gaming machine of the type wherein a large number of players participate in a game for allowing a large number of players to participate in a game with one gaming machine to play a game at the same time, such as a roulette gaming machine, a bingo gaming machine, or a horse race gaming machine, and in particular to a gaming machine of the type wherein a large number of players participate in a game, the gaming machine provided with a plurality of cumulative storage units for cumulatively storing game medium of a predetermined value for paying out the game medium of the cumulative predetermined value stored in any of the cumulative storage units based on the lottery result, thereby providing various games and more promoting a sense of anticipation of the player for the game result.

2. Description of the Related Art

A game in a gaming machine of the type wherein a large number of players participate in a game using medals as game medium, such as a roulette gaming machine, a bingo gaming machine, or a horse race gaming machine, is a game that can be started as the player purchases or borrows a plurality of medals with a medal lending machine and inputs the medal into the gaming machine. If the player wins the game, a predetermined number of medals are paid out to the player. Therefore, the player who can gain a large number of medals can enjoy continuously playing another game without purchasing or borrowing new medals.

In recent years, in such a gaming machine of the type wherein a large number of players participate in a game, it has been in fashion to provide a bonus game different in the game mode from a base game as a measure for attracting a player's interest. For example, such a bonus game is started in a base game at a given probability and a high-value award based on the jackpot accumulated in the games is given to the player based on the result of the bonus game. For example, JP-A-2001-161888 describes a bingo gaming machine for enabling the player to play a multicard bingo game using a plurality of lottery squares and a jackpot game wherein the player can gain a jackpot in addition to a usual line bingo game; if a predetermined participation condition of medal input, etc., is satisfied, the bingo gaming machine enables the player to select any desired game from among the games and play the selected game.

SUMMARY OF THE INVENTION

However, in a gaming machine of the type wherein a large number of players participate in a game having only one jackpot like the bingo gaming machine described in JP-A-2001-161888, the probability that a jackpot will occur is previously determined in the gaming machine and if any player gains the jackpot, the possibility that each player may win a jackpot becomes extremely low later for the time being.

Further, later if one player wins a jackpot, the amount of game medium that can be gained lessens. Therefore, if any player wins the jackpot, not only the winning player, but also other players have a lessened sense of anticipation for the jackpot and the reduced game play wish and cancel game play.

It is therefore an object of the invention to provide a gaming machine of the type wherein a large number of players participate in a game, the gaming machine provided with a plurality of cumulative storage units for paying out game medium of a cumulative predetermined value stored in any cumulative storage units based on the lottery result, thereby making it possible to more promote a sense of anticipation of the player for the game result concerning acquisition of a jackpot and maintain the game play wish regardless of win of a jackpot.

To the end, according to a first aspect of the invention, there is provided a gaming machine of the type wherein a large number of players participate in a game, the gaming machine including: a plurality of game terminals each including an operation section for accepting operation of a player, an acceptance unit for accepting game medium, and an image display unit for displaying a predetermined image; a plurality of cumulative storage units for cumulatively storing a predetermined value of the game medium accepted by the acceptance unit; a game control unit for controlling a game based on a base game or a bonus game having a different game mode from the base game; a first lottery unit for performing a lottery as to whether or not the bonus game is generated for each of the plurality of game terminals; a second lottery unit for performing a lottery as to whether or not game medium of the cumulative predetermined value stored in any of the plurality of cumulative storage units are paid out for each game terminal when the bonus game is generated according to the lottery result of the first lottery unit; and a cumulative game medium payout unit for paying out the game medium of the cumulative predetermined value cumulatively stored in the cumulative storage unit determined based on the lottery result of the second lottery unit to the determined game terminal, when the game medium are paid out at any game terminal according to the lottery result of the second lottery unit.

The game medium include media based on credit data recorded on a magnetic card, an IC card, etc., as well as embodied media such as a medal and a coin.

The cumulative game medium payout unit includes payout of some or all of the cumulative game value stored in the cumulative storage unit.

The first lottery unit and the second lottery unit may be executed at different times or at the same timing.

Further, the first lottery unit and the second lottery unit may be executed separately at the game terminal or may be executed collectively for a plurality of game terminals.

In the gaming machine of the type wherein a large number of players participate in a game according to the first aspect of the invention, a plurality of cumulative storage units that is different in the ratio of game medium stored for the game medium accepted by the acceptance unit are provided, and if the second lottery unit determines that the game medium are to be paid out at any game terminal, the game medium of the cumulative predetermined value stored in any of the plurality of cumulative storage units are paid out, and the game medium cumulatively stored in the cumulative storage unit determined based on the lottery result are paid out, so that a sense of anticipation of the player for the game result concerning acquisition of a jackpot can be more promoted and the game play wish of the player can be maintained regardless of win of a jackpot. Since a jackpot lottery is held every game, it is made possible to allow the player to always have a sense of anticipation for acquisition of jackpot.

Further, expectation for the remaining cumulative storage units is not lost still after the game medium of the cumulative predetermined value stored in any cumulative storage units are paid out, so that it is made possible to maintain the game play wish of the player. Therefore, it is made possible to allow the player to continue to play a game.

BRIEF DESCRIPTION OF THE DRAWINGS

These and other objects and advantages of the present invention will be more fully apparent from the following detailed description taken in conjunction with the accompanying drawings, in which:

FIG. 8 is a drawing to show a bonus lottery pattern table according to the embodiment of the invention;

DETAILED DESCRIPTION OF THE EMBODIMENTS

A gaming machine of the type wherein a large number of players participate in a game according to the invention will be discussed in detail with reference to the accompanying drawings based on an embodiment of a roulette gaming machine 1 as the a gaming machine of the type wherein a large number of players participate in a game.

The roulette gaming machine 1 is a gaming machine in which a player predicts the number, etc., determined in a roulette unit 2 and bets game medium such as his or her owned medals on the predicted number, etc., and when the bet number, etc., wins, the player can receive payout of a predetermined number of medals.

Figure 1:
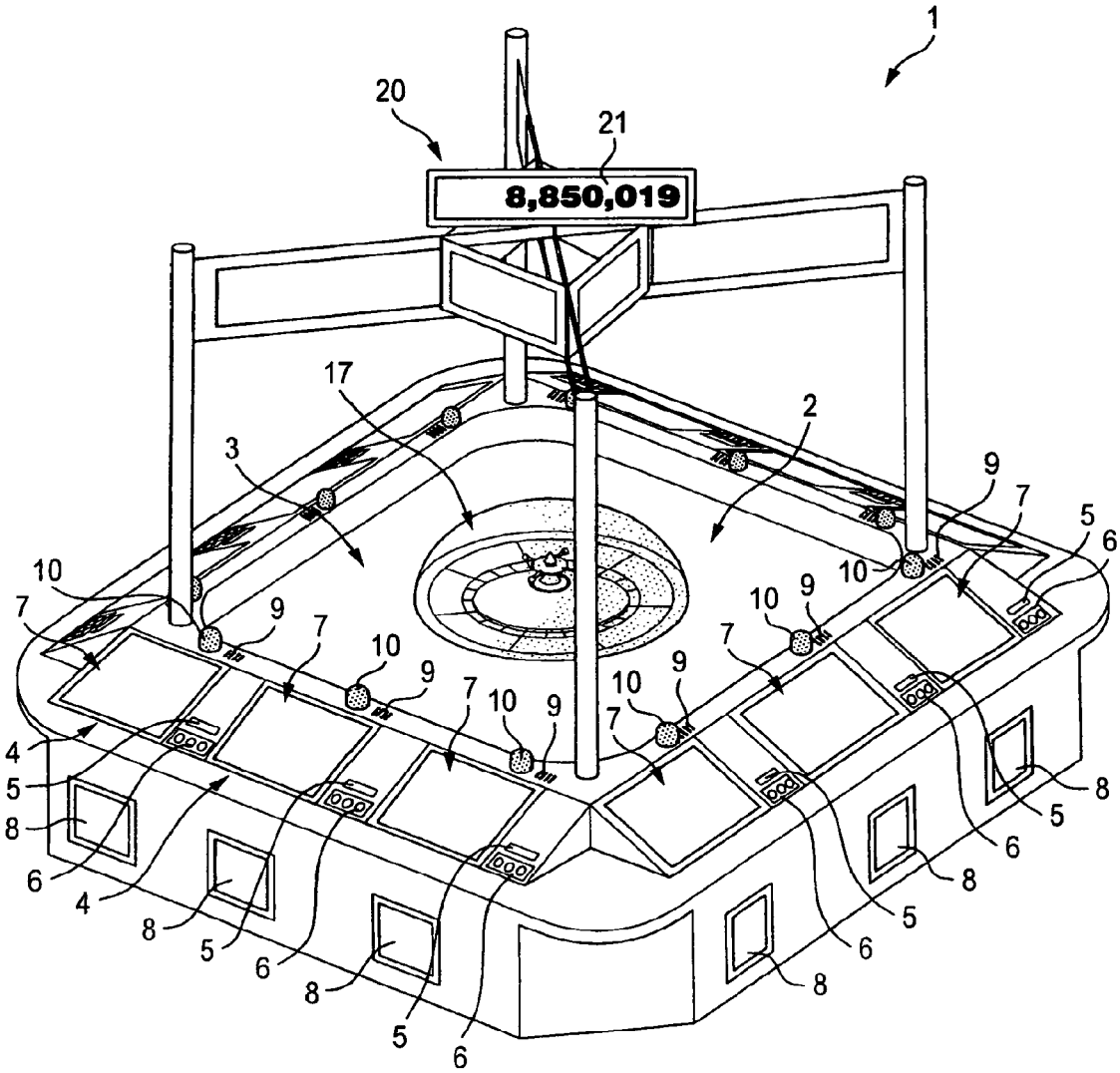
FIG. 1 is an external perspective view to show the schematic configuration of a roulette gaming machine according to an embodiment of the invention.

To begin with, the schematic configuration of the roulette gaming machine 1 according to the embodiment of the invention will be discussed based on FIG. 1. FIG. 1 is an external perspective view to show the schematic configuration of the roulette gaming machine 1 according to the embodiment.

As shown in FIG. 1, the roulette gaming machine 1 is basically made up of a cabinet 3 of a main body, a roulette unit 2 provided roughly in the center of the top face of the cabinet 3, a plurality of (in the embodiment, 12) satellites 4 placed so as to surround the roulette unit 2, and an electronic display section 20.

The satellite 4 refers to a game area having at least a medal insertion slot 5 for inputting game medium such as coins and medals used to play a game, a control section 6 made up of control buttons, etc., operated by a player to enter predetermined commands, and an image display 7 for displaying an image involved in a game. The player can operate the control section 6, etc., while seeing the image displayed on the image display 7, thereby advancing the developed game.

Medal payout openings 8 are provided on the sides of the cabinet 3 where the satellites 4 are installed. Further, a speaker 9 for producing music, effect sound, etc., is provided in the upper right portion of the image display 7 of each satellite 4.

Further, a WIN lamp 10 is provided above the image display 7 of each satellite 4. The WIN lamp 10 included in the satellite 4 making a transition to a bonus game wherein the player can gain a jackpot (JP) as described later goes on in red, informing the surrounding players that the satellite 4 makes a transition to a predetermined bonus game. The WIN lamp 10 included in the satellite 4 where the player gains a JP in the bonus game is lighted in yellow, thereby informing the surrounding players that the player gains a JP in the satellite 4. The WIN lamp 10 is placed at a position where it can be visually recognized from all installed satellites 4 (in the embodiment, 12 satellites), enabling other players playing a game with the same gaming machine 1 to always check that the WIN lamp 10 is on.

The gaming machine 1 according to the embodiment provides the three types of JPs of "MEGA," "MAJOR," and "MINI" as described later. The JP of "MEGA" cumulatively stores 0.5% credit of bet credit in a base game (roulette game) using a BET screen 31 described later in all 12 satellites 4; the JP of "MAJOR" cumulatively stores 0.2% credit of bet credit; and the JP of "MINI" cumulatively stores 0.1% credit of bet credit. The cumulative credit count of each JP becomes a win of any one JP if a predetermined condition is satisfied in a bonus game described later, and the corresponding JP is paid out. The electronic display section 20 is provided with a JP amount display section 21 for displaying the amount of the JP of "MEGA" particularly among the JPs. The JP amount display section 21 is provided on the top of the electronic display section 20, so that the display can be visually recognized from all players playing a game in the satellites 4.

A medal sensor 97 (see FIG. 10) is provided inside the medal insertion slot 5 for identifying the game medium such as medals input through the medal insertion slot 5 and counting the number of the input medals. A hopper 94 (see FIG. 10) is provided inside the medal payout opening 8 for paying out a predetermined number of medals from the medal payout opening 8.

Figure 2:
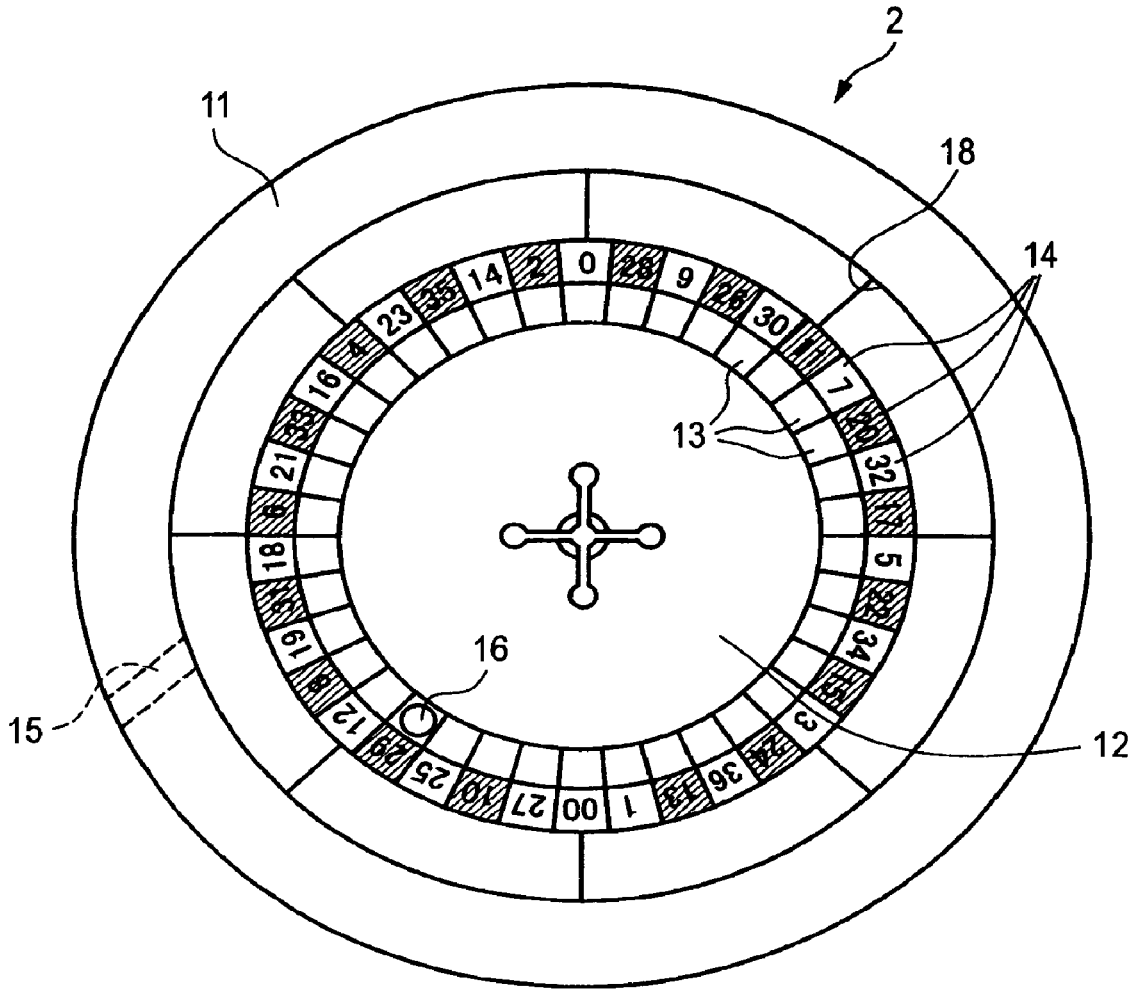
FIG. 2 is a plan view of a roulette wheel according to the embodiment of the invention.

Next, the configuration of the roulette unit 2 according to the embodiment will be discussed with FIG. 2. FIG. 2 is a plan view of the roulette unit according to the embodiment.

As shown in FIG. 2, the roulette unit 2 is basically made up of a frame 11 fixed to the cabinet 3 and a rotation disk 12 housed and supported in the inside of the frame 11 for rotation. The rotation disk 12 is formed on the top face with a large number of (in the embodiment, 38) concave ball housing grooves 13. Further, number indication plates 14 indicating numbers of 0, 00, and 1 to 36 as graphic characters in a one-to-one correspondence with the ball housing grooves 13 are formed on the top face of the rotation disk 12 in the outer direction of the ball housing grooves 13.

A ball input port 15 is formed in the frame 11. A ball input unit (not shown) is joined to the ball input port 15 and a ball 16 is input onto the rotation disk 12 from the ball input port 15 with drive of the ball input unit. The whole above the roulette wheel is covered with a transparent acrylic cover member 17 shaped like a hemisphere.

The frame 11 is inclined gently to the inside and is formed in an intermediate portion with a guide wall 18 for guiding the input ball 16 against the centrifugal force and rolling the ball 16. As the rotation speed reduces and the centrifugal force is lost, the ball 16 rolls down the slope of the frame 11 and goes to the inside thereof and arrives at the rotating rotation disk 12.

The ball 16 rolling to the rotation disk 12 is housed in any ball housing groove 13 through the tops of the number indication plates 14 outside the rotating rotation disk 12, and the number described on the number indication plate 14 corresponding to the ball housing groove 13 in which the ball 16 is housed becomes the win number.

A win determination unit (not shown) is installed below the rotating rotation disk 12. The win determination unit is a unit for determining which number the ball 16 is housed in the ball housing groove 13 corresponding to. Further, a ball collection unit (not shown) is installed below the rotation disk 12. The ball collection unit is a unit for collecting the ball 16 on the rotation disk 12 after each game is over. The ball input unit, the win determination unit, and the ball collection unit are already known and therefore will not be discussed again in detail.

Next, the configurations of the control section 6 and the image display 7 according to the embodiment will be discussed.

The control section 6 is provided on the side of the image display 7 of the satellite 4 and buttons operated by the player are placed, as shown in FIG. 1. Specifically, a BET confirmation button 22, a payback (CASHOUT) button 23, and a help (HELP) button 24 are placed from the left to the right viewed from the position opposed to the satellite 4.

The BET confirmation button 22 is a button pressed by the player to confirm the bet after bet operation with the image display 7 described later. If the bet is confirmed and the player has bet a medal on the number described on the number indication plate 14 corresponding to the ball housing groove 13 in which the ball 16 is housed on the roulette wheel during the gaming, the player wins the game. If the player wins the game, the credit points responsive to the number of the bet chips are added to the current owned credit points of the player. The bet operation is described later in detail.

The payback button 23 is a button usually pressed by the player when the game is over. When the player presses the payback button 23, medals responsive to the current owned credit points of the player, gained by the games, etc., (usually, one medal to one credit point) are paid back to the player from the medal payout opening 8.

The help button 24 is a button pressed by the player if the player is unfamiliar with the game operation method, etc. When the player presses the help button 24, immediately a help screen indicating various pieces of operation information is displayed on the image display 7.

On the other hand, the image display 7 is a touch-panel liquid crystal display with a touch panel 28 attached to the front of the liquid crystal display. The player can press an icon displayed on a liquid crystal screen 29 with a finger, etc., for selecting the icon. FIGS. 3 to 6 are drawings to show examples of display screens displayed on the image display during the gaming.

Figure 3:
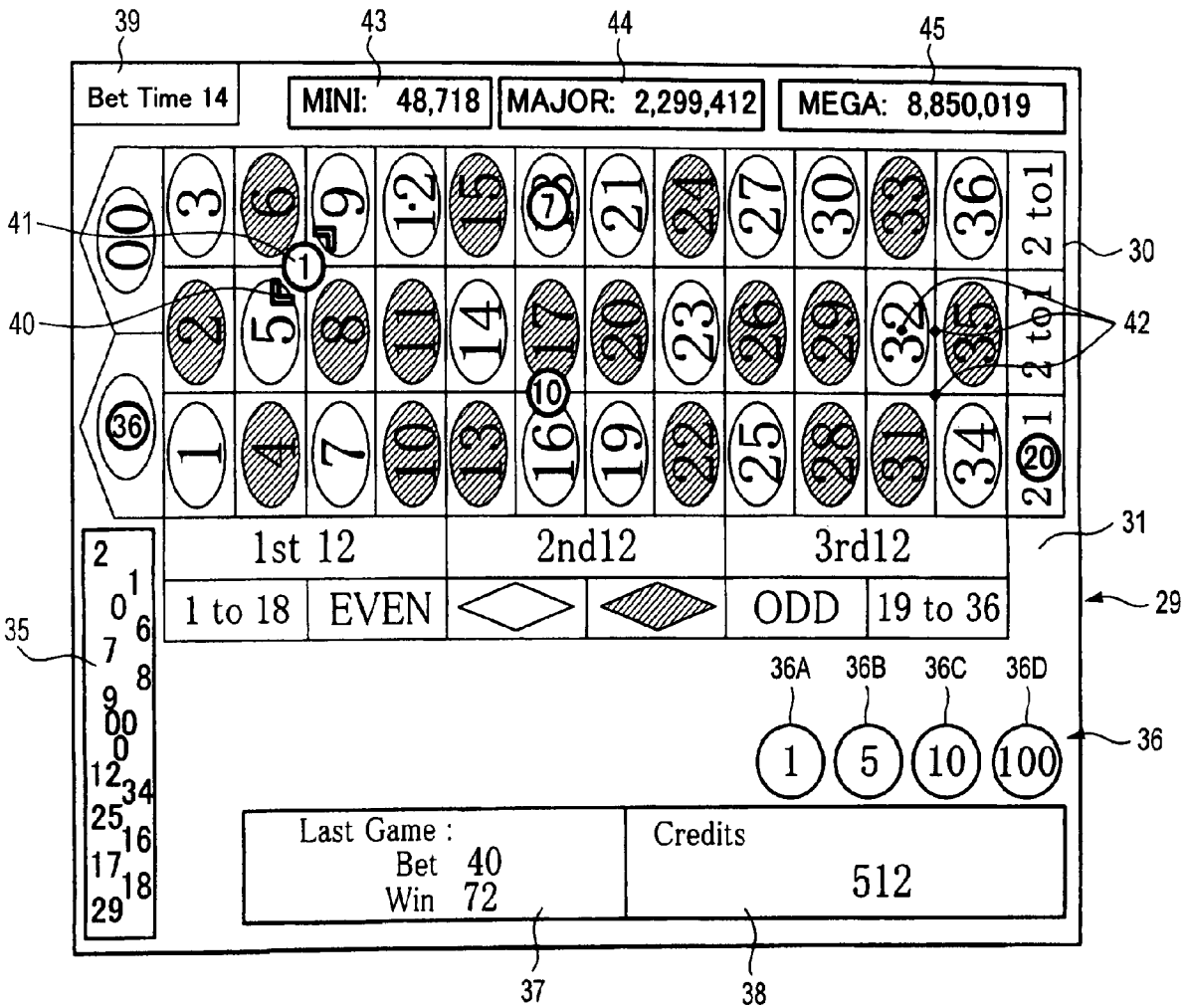
FIG. 3 is a drawing to show a BET screen displayed on an image display.

As shown in FIG. 3, during the gaming with the roulette gaming machine 1, the image display 7 basically displays two types of screens of the above-mentioned BET screen 31 having a table betting board 30 for predicting the win number and betting a chip and a bonus game screen 33 occurring at a predetermined probability after the expiration of the chip bet period by the player for the player to play a bonus game to gain each JP of "MINI," "MAJOR," "MEGA."

The player uses the BET screen 31 to play a base game for predicting the game result of the roulette unit 2 and betting a chip using his or her owned credit. The player uses the bonus game screen 33 to play a bonus game wherein the player selects two kinds of cocktails from among six kinds of cocktails displayed on the liquid crystal screen 29 and if the selected two kinds of cocktails change to a predetermined combination mark, the player wins the JP of "MINI," "MAJOR," or "MEGA" and can obtain a large number of credit points accumulated so far, as described later.

First, the BET screen 31 used for a base game will be discussed based on FIG. 3. The same numbers as the numbers 0, 00, and 1 to 36 indicated on the number indication plates 14 are arranged like squares on the table betting board 30 displayed on the BET screen 31. Special BET areas for the player to bet a chip by specifying "odd number," "even number," "color of number indication plate (red or black), or "given number range (for example, 1 to 12 or the like)" are also arranged like squares.

Displayed below the table betting board 30 are a result history display section 35, unit BET buttons 36, a payback result display section 37, and a credit count display section 38 from the left to the right of the screen.

The result history display section 35 lists the results of the win numbers in the previous games (one game refers to an operation sequence from the player betting a chip at each satellite 4 to the ball 16 dropping to the ball housing groove 13 to paying out credit based on the win number). When one game is over, a new win number is added to the top of the result history display section 35 for display and the player can check the history of the win numbers of a maximum of 16 games.

The unit BET buttons 36 are buttons for betting chips on a BET area 42 (on number or mark square or on square forming line) specified by the player. The unit BET buttons 36 include 1-BET button 36A, 5-BET button 36B, 10-BET button 36C, and 100-BET button 36D.

The player first specifies the BET area 42 with a cursor 40 described later by directly pressing the screen with a finger, etc. In this state, if the player presses the 1-BET button 36A, the player bets one chip at a time (the number of bet chips increases from one to two to three to . . . each time the player presses the 1-BET button 36A with a finger, etc.,). If the player presses the 5-BET button 36B, the player bets five chips at a time (the number of bet chips increases from five to 10 to 15 to . . . each time the player presses the 5-BET button 36B with a finger, etc.,). If the player presses the 10-BET button 36C, the player bets 10 chips at a time (the number of bet chips increases from 10 to 20 to 30 to . . . each time the player presses the 10-BET button 36C with a finger, etc.,). Further, if the player presses the 100-BET button 36C, the player bets 100 chips at a time (the number of bet chips increases from 100 to 200 to 300 to . . . each time the player presses the 100-BET button 36D with a finger, etc.,).

Therefore, to bet a large number of chips, the operation can be simplified.

The payback result display section 37 displays the number of bet chips of the player in the preceding game and the paid-back credit count. Here, subtracting the number of bet chips from the paid-back credit count results in the credit count newly gained by the player playing the preceding game.

Further, the credit count display section 38 displays the credit count owned by the player at present. When the player bets chips, the credit count is decremented by the number of the bet chips (one credit point per chip). If the player wins the game and the corresponding credit points are paid back, the credit count is incremented by the paid-back credit points. If the credit count owned by the player reaches 0, the game is over.

A BET time display part 39 is provided at the top of the table betting board 30. The BET time indication part 39 is indicates the remaining time during which the player can bet. At the acceptance start time of bet operation, "20" is displayed and then the count is decremented by one every second. When the count reaches "0," the acceptance of bet operation is terminated. If the remaining bet period of the player at each satellite 4 becomes five seconds, a ball input unit 85 is driven for inputting the ball 16 into the roulette wheel.

Further, provided to the right of the BET time indication part 39 are a MINI indication part 43 for indicating the credit count accumulated so far in the JP of "MINI," a MAJOR indication part 44 for indicating the credit count accumulated so far in the JP of "MAJOR," and a MEGA indication part 45 for indicating the credit count accumulated so far in the JP of "MEGA." 0.1% credit of bet credit at the 12 satellites 4 in total is cumulatively added to the MINI indication part 43; 0.2% credit of bet credit is cumulatively added to the MAJOR indication part 44; and 0.5% credit of bet credit is cumulatively added to the MEGA indication part 45. The common numeric values are displayed at all satellites 4. If a predetermined condition is satisfied in a bonus game described later, JP is won and the credit count of the won JP of the JPs indicated in the indication parts 43 to 45 is paid out and the initial value ("MINI"=400 credit points, "MAJOR"=15000 credit points, "MEGA"=50000 credit points) is indicated in the paid-out JP indication part. The credit count accumulated so far in the JP of "MEGA" is indicated not only in the MEGA indication part 45, but also in the JP amount display section 21 of the electronic display section 20.

A cursor 40 indicating the BET area 42 selected by the player at present is displayed on the table betting board 30. A chip mark 41 indicating the number of bet chips and the selected BET area 42 so far is also displayed on the table betting board 30. The number displayed on the chip mark 41 denotes the number of bet chips. For example, the chip mark 41 of 7 placed on the square 18 as shown in FIG. 3 indicates that the player bets seven chips on the number 18. The betting method only on one number is called "straight up."

The chip mark 41 of 1 placed at the intersection of the squares 5, 6, 8, and 9 indicates that the player bets one chip on the four numbers covering 5, 6, 8, and 9. The betting method covering four numbers is called "corner bet."

Other available bet methods are as follows: "Split bet" for betting a chip covering two numbers on the line between the two numbers; "street bet" for betting a chip covering three numbers (for example, 13, 14, and 15) on the end of a horizontal row of the numbers (in FIG. 3, one row in the vertical direction); "five bet" for betting a chip covering five numbers of 0, 00, 1, 2, and 3 on the line between the numbers 00 and 3; "line bet" for betting a chip covering six numbers (for example, 13, 14, 15, 16, 17, and 18) among numbers of two horizontal rows of the numbers (in FIG. 3, two rows in the vertical direction); "column bet" for betting a chip covering 12 numbers on the square written as "2 to 1;" and "dozen bet" for betting a chip covering 12 numbers on the square written as "1st 12," "2nd 12," or "3rd 12." Further, bet methods each covering 18 numbers depending on the number indication plate color (red or black), odd or even number, whether the number is equal to or less than 18 or is equal to or more than 19 using six squares provided at the bottom stage of the table betting board 30 are also available. The bet methods differ in credit award (odds) per chip when the player wins the game in betting the chip (chips).

To bet a chip on the BET screen 31 described above, first the player specifies the BET area 42 (on number or mark square or on square forming line) to bet on the screen and presses the BET area 42 directly with a finger. Consequently, the cursor 40 moves to the specified BET area 42.

Then, whenever the player presses one of the unit BET buttons 36 (1-BET button 36A, 5-BET button 36B, 10-BET button 36C, 100-BET button 36D), as many chips as the number indicated by the unit BET button are bet on the specified BET area 42. For example, if the player presses the 10-BET button 36C four times, the 5-BET button 36B once, and the 1-BET button 36A three times, a total of 48 chips can be bet.

Figure 5:
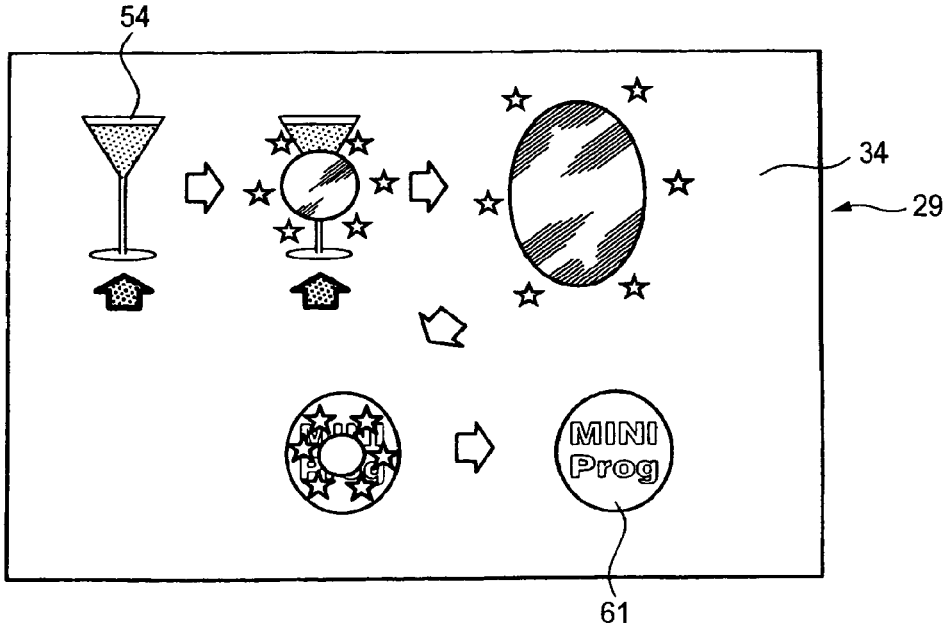
FIG. 5 is a drawing to show a selection result display screen displayed on the image display.
Figure 6:
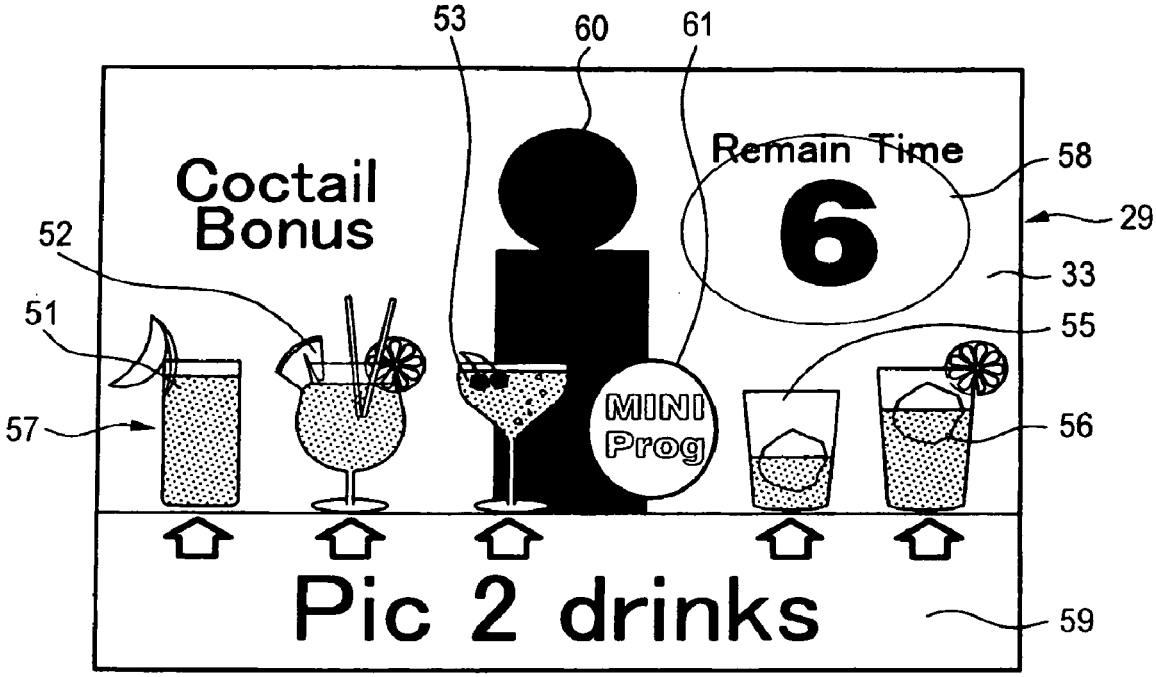
FIG. 6 is a schematic representation to show the bonus game screen after a player selects a cocktail and a symbol is displayed.

Next, the bonus game screen 33 will be discussed based on FIGS. 4 to 6. After the expiration of the bet period with the BET screen 31, namely, if the BET time indication part 39 indicates "0," the screen makes a transition from the BET screen 31 to the bonus game screen 33 at a given probability. Specifically, a lottery is held for each satellite 4 based on the random number sampled through a random number sampling circuit 78 (see FIG. 9) at the appropriate timing after the expiration of the bet time and a bonus lottery pattern table 50 (see FIG. 8) stored in ROM 81 and if the lottery result unit occurrence of a bonus game and the number of bet chips on a base game (roulette game using the BET screen 31) at the satellite 4 corresponding to the lottery result meaning occurrence of a bonus game is 50 or more, the BET screen 31 at the corresponding satellite 4 makes a transition to the bonus game screen 33.

Figure 4:
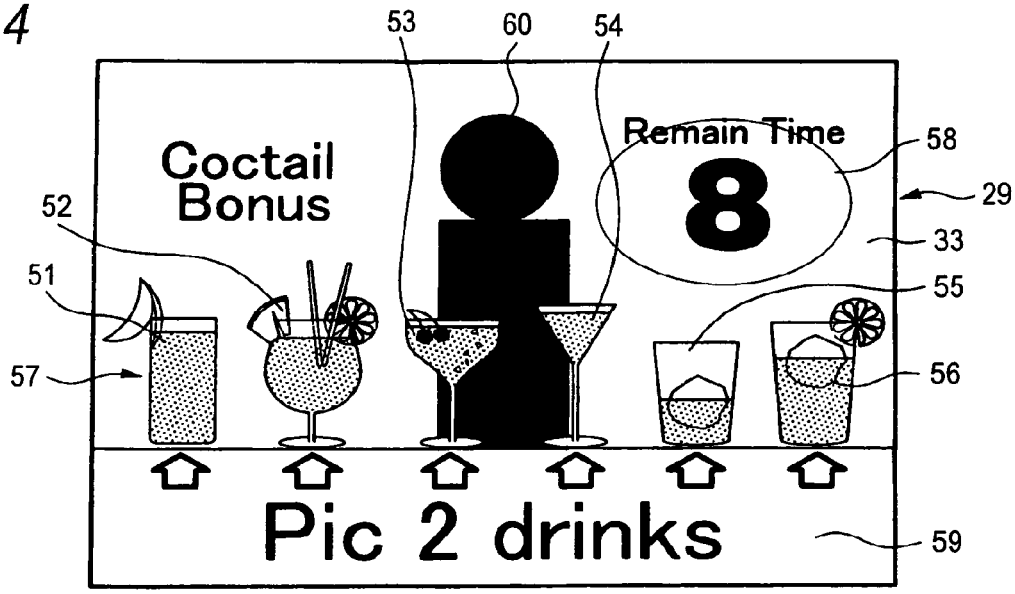
FIG. 4 is a drawing to show a bonus game screen displayed on the image display.

The bonus game screen 33 is basically made up of a cocktail display section 57 for displaying the images of a first cocktail 51, a second cocktail 52, a third cocktail 53, a fourth cocktail 54, a fifth cocktail 55, and a sixth cocktail 56 imitating six types of cocktails, a bonus time display section 58 for indicating the remaining time of the bonus game, and a comment display section 59 for displaying various comments in accordance with the situation of the bonus game, as shown in FIG. 4. Further, a person image 60 imitating the figure of a bartender is displayed between the third cocktail 53 and the fourth cocktail 54.

The player can select up to a maximum of two from among the first cocktail 51 to the sixth cocktail 56 displayed in the cocktail display section 57 as the player touches the touch panel 28 with a finger, etc., and the touch panel 28 detects the touch. If any cocktail is selected, the display of the liquid crystal screen 29 switches from the bonus game screen 33 to a selection result display screen 34 shown in FIG. 5 and an effect image indicating gradual change of the selected cocktail from among the first cocktail 51 to the sixth cocktail 56 (in FIG. 5, the fourth cocktail 54) to a symbol 61 is displayed for a predetermined time (for example, 0.5 sec).

Figure 7:
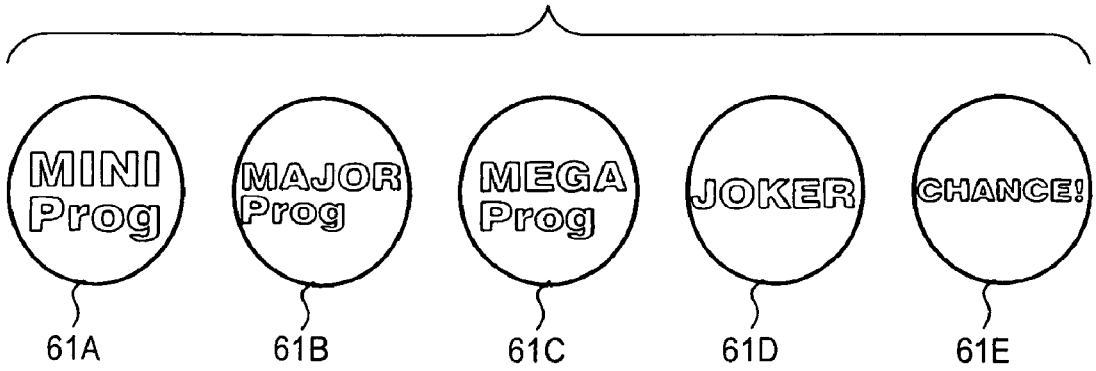
FIG. 7 is a drawing to show a list of symbols displayed on the bonus game screen.

Five symbols 61A to 61E with indications of "MINI Prog," "MAJOR Prog," "MEGA Prog," "JOKER," and "CHANCE!" as shown in FIG. 7 are included in the symbol 1. The player is informed of the lottery result of the bonus game according to the displayed symbol 61 combination. FIG. 7 is a drawing to show a list of the symbols displayed when a cocktail is selected. However, in the roulette gaming machine 1 according to the embodiment, which of the five symbols 61A to 61E is to be displayed when the player selects any of the first cocktail 51 to the sixth cocktail 56 is previously determined by internal lottery using the random number after the expiration of the bet time. (See S108 in FIG. 13.)

At the termination of the display of the selection result display screen 34 for the predetermined time (for example, 0.5 sec), again the display of the liquid crystal screen 29 switches to the bonus game screen 33. At the time, the selected cocktail of the first cocktail 51 to the sixth cocktail 56 is displayed in a state in which the selected cocktail changes to the symbol 61 displayed on the selection result display screen 34.

The bonus time display section 58 displays the remaining time for allowing the player to select two cocktails from among the first cocktail 51 to the sixth cocktail 56 in the bonus game; when the bonus game starts, "8" is displayed and the digit is incremented by one every second. When the digit reaches "0," if the player does not select any cocktail, two cocktails are selected from among the first cocktail 51 to the sixth cocktail 56 at random. On the other hand, if the player selects only one cocktail, one cocktail is selected from among the remaining fives of the first cocktail 51 to the sixth cocktail 56 at random. When the remaining time reaches "0," if cocktails are selected at random, the selection result display screen 34 is not displayed and the cocktails selected at random on the bonus game screen 33 are instantaneously changed to the symbols 61 of the types previously determined by internal lottery for display.

The bonus game screen 33 and the selection result display screen 34 are repeatedly displayed and if the symbols 61 of the same type are displayed as a result of selecting two cocktails, the JP based on the displayed symbol 61 type (JP of "MINI" on the symbol 61A of "MINI Prog," JP of "MAJOR" on the symbol 61B of "MAJOR Prog," or JP of "MEGA" on the symbol 61C of "MEGA Prog") is won. Particularly, if two symbols 61E of "CHANCE!" are displayed, a rank-up JP for ranking up (changing) from the JP of "MINI" to the JP of "MEGA" is won. The rank-up JP is described later in detail.

On the other hand, if the symbols 61 of different types are displayed, the JP is lost. However, as an exception, if the symbol 61D of "JOKER" is displayed, the JP based on the types of displayed remaining symbols 61 is won.

A comment matched with the current situation of the bonus game is displayed in the comment display section 59. For example, a character string of "Pic 2 drinks" is displayed for prompting the player to make cocktail selection before termination of cocktail selection from among the first cocktail 51 to the sixth cocktail 56 displayed on the cocktail display section 57. If the player gains JP with the symbols 61 of the same type displayed as a result of selecting two cocktails, a message indicating that the player wins JP and the paid-out credit count are displayed (see FIG. 17). On the other hand, if the symbols 61 of different types are displayed, the JP is lost, and a character string of "SORRY" is displayed for informing the player that the player does not win JP (see FIG. 18). Further, if the player wins "rank-up JP," a comment suggesting the possibility of ranking up from the JP of "MINI" to the JP of "MEGA" is displayed (see FIG. 19).

Next, the bonus lottery pattern table 50 used for lottery when a transition is made to a bonus game after the expiration of the bet period will be discussed based on FIG. 8. FIG. 8 is a schematic representation to show the bonus lottery pattern table 50. In FIG. 8, the range of the random numbers used with the bonus lottery pattern table 50 is 0 to 8388607 and the random numbers corresponding to the satellites 4 (since 12 satellites 4 are provided in the embodiment, 12 numeric values corresponding to the 12 satellites 4) are sampled by the random number sampling circuit 78 when the bet period expires.

The types of symbols 61 displayed when the cocktails are selected from among the first cocktail 51 to the sixth cocktail 56 on the bonus game screen 33 (see FIG. 4) and the win result are determined based on the sampled numeric value.

The determined symbol types are two of "first" and "second" and the "first" symbol indicates the type of symbol 61 to which the cocktail 51 to the cocktail 56 first selected by the player changes. The "second" symbol indicates the type of symbol 61 to which the cocktail 51 to the cocktail 56 second selected by the player changes. However, if two cocktails are selected at random when the remaining time in the bonus time display section 58 reaches "0," the "first" and "second" symbols are displayed on the two cocktails selected at random at the same time.

The bonus lottery pattern table 50 will be discussed more specifically. When the sampled random number is in the range of 0 to 3, the first selected cocktail is changed to the symbol 61E of "CHANCE!" and the second selected cocktail is changed to the symbol 61E of "CHANCE!" and the player obtains the lottery result of winning "rank-up JP."

When the sampled random number is in the range of 9 to 12, the first selected cocktail is changed to the symbol 61C of "MEGA" and the second selected cocktail is changed to the symbol 61C of "MEGA" and the player obtains the lottery result of winning the JP of "MEGA."

When the sampled random number is in the range of 6668 to 7267, the first selected cocktail is changed to the symbol 61E of "CHANCE!" and the second selected cocktail is changed to the symbol 61C of "MEGA" and the player obtains the lottery result of losing not winning any JP.

When the sampled random number is in the range of 26668 to 8388607, the player obtains the lottery result of a losing generating no bonus game. If no bonus game is generated, the roulette gaming machine 1 allows the player to play only a base game (roulette game) based on the BET screen 31 without displaying the bonus game screen 33 or the selection result display screen 34.

Likewise, if the random number is in any other range, the symbol 61 to which the cocktail changes and the win description are determined as listed in the bonus lottery pattern table 50. However, in the roulette gaming machine 1 according to the embodiment, if the number of bet chips on a base game (roulette game based on the BET screen 31) is 50 or less although a bonus game is to be generated (random number ranging from 0 to 26667), no bonus game is generated regardless of the win description (S122 in FIG. 15).

The "rank-up JP" won when the random number is in the range of 0 to 8 will be discussed. The "rank-up JP" is a special JP win mode guaranteeing win of JP of "MINI" and having the possibility of ranking up (changing) to JP of "MEGA."

Specifically, JP of "MINI" or JP of "MEGA" is determined based on the game result of a base game (roulette game using the BET screen 31) played when a bonus game is generated. If the award of the base game (roulette game based on the BET screen 31) is 200 credit points or more, JP of "MEGA" is won. If the award of the base game is less than 200 credit points, JP of "MINI" is won (see S134 to S136 in FIG. 16).

Figure 9:
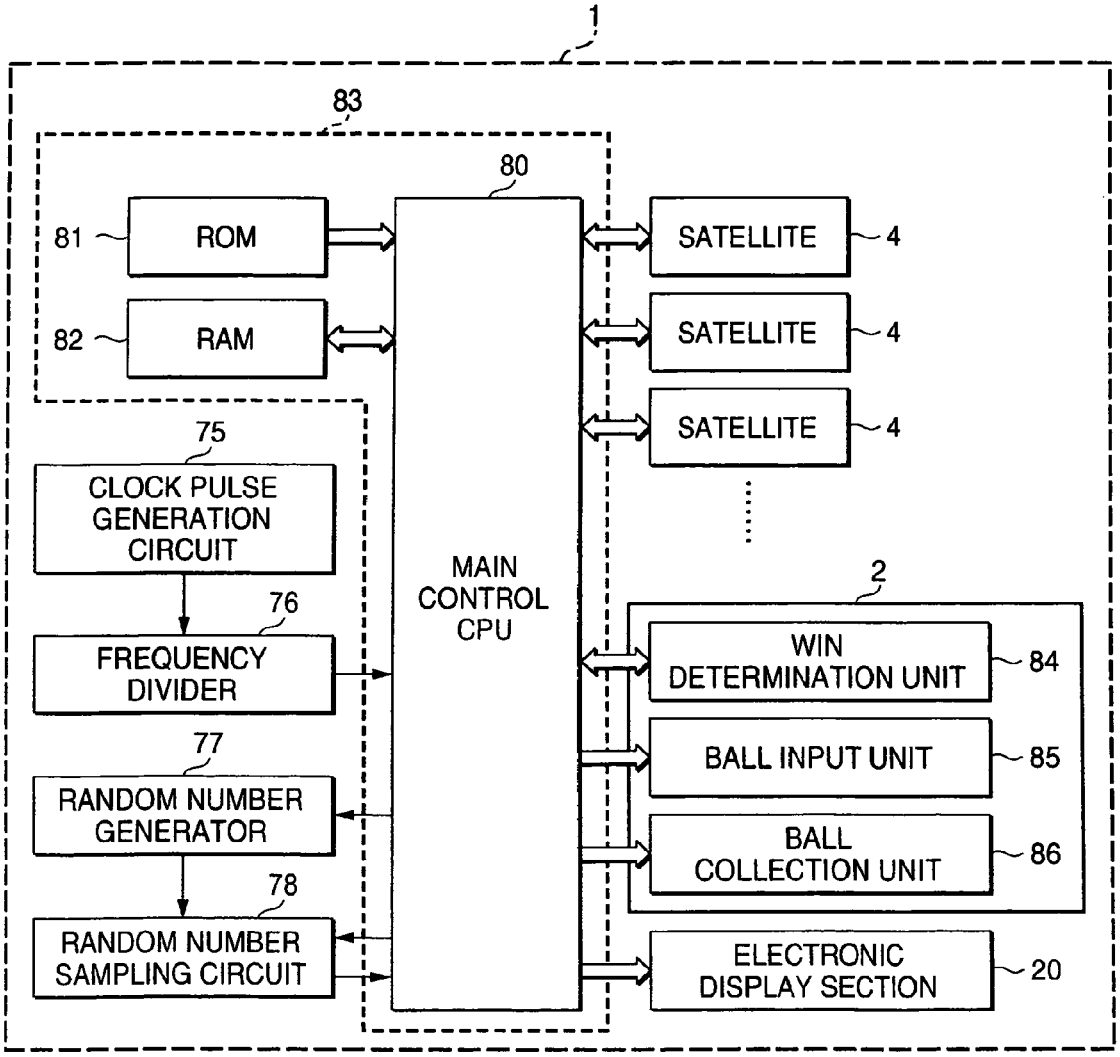
FIG. 9 is a block diagram to schematically show a control system of the roulette gaming machine according to the embodiment of the invention.

Next, the configuration of a control system of the roulette gaming machine 1 will be discussed based on FIG. 9. FIG. 9 is a block diagram to schematically show the control system of the roulette gaming machine.

As shown in FIG. 9, the roulette gaming machine 1 is made up of a main control section 83 including a main control CPU 80, ROM 81, and RAM 82 and the roulette unit 2 and the 12 satellites 4 (see FIG. 1) connected to the main control section 83. The control system of the satellite 4 is described later in detail.

The main control CPU 80 performs various types of processing based on input signals, etc., supplied from the satellites 4 and data and programs stored in the ROM 81 and the RAM 82, and transmits instruction signals to the satellites 4 based on the processing result, thereby controlling the satellites 4 under the initiative of the main control CPU 80 for advancing games. Further, the main control CPU 80 controls a win determination unit 84, the ball input unit 85, and a ball collection unit 86 installed in the roulette unit 2 for inputting the ball 16 into the roulette wheel of the roulette unit 2, collecting the ball 16 from the roulette wheel, and determining the win number corresponding to the ball housing groove 13 into which the ball 16 drops. The main control CPU 80 makes a win or loss determination of bet chips based on the obtained win number and bet information transmitted from each satellite 4 and calculates the credit count to be paid out to the player at the satellite 4. When a bonus game is generated and particularly the player wins the JP of any of "MINI," "MAJOR," or "MEGA," the credit corresponding to the won JP is paid out to the player.

The ROM 81 is implemented as semiconductor memory, etc., for example, and stores a program for providing the basic function of the roulette gaming machine 1, a program for controlling the units in the roulette unit 2, the odds for a roulette game using the BET screen 31 (the credit payout number of chips responsive to a win per chip), the bonus lottery pattern table 50 (see FIG. 8), a program for controlling the satellites 4 under the initiative of the main control CPU 80, and the like.

On the other hand, the RAM 82 temporarily stores chip bet information supplied from the satellites 4, the win number of the roulette unit 2 determined by the win determination unit 84, the current credit count cumulatively stored in the JP of each of "MINI," "MAJOR," and "MEGA," data concerning the result of the processing executed by the main control CPU 80, and the like.

The win determination unit 84, the ball input unit 85, and the ball collection unit 86 installed in the roulette unit 2 are also connected to the main control CPU 80. If the remaining time of the bet time of the player at each satellite 4 becomes five seconds, namely, if the BET time indication part 39 of the BET screen 31 indicates a digit of 5, the ball input unit 85 is driven for inputting the ball 16 into the roulette wheel.

Further, when the rotation speed of the ball 16 gradually reduces and the ball 16 loses the centrifugal force, rolls down the slope of the frame 11, and is housed in any ball housing groove 13, the win determination unit 84 determines the number described on the number indication plate 14 corresponding to the ball housing groove 13 in which the ball 16 is housed, and transmits the determination result to the main control CPU 80. Then, the ball collection unit 86 is driven for collecting the ball 16 from the top of the roulette wheel.

A clock pulse generation circuit 75 for generating a reference clock pulse and a frequency divider 76 are connected to the main control CPU 80. Further, a random number generator 77 for generating a random number and the random number sampling circuit 78 are connected to the main control CPU 80. The random number sampled through the random number sampling circuit 78 is used for a lottery concerning generation of a bonus state. Specifically, after the expiration of the bet period, a lottery concerning generation of a bonus state is held based on the random number sampled in the random number sampling circuit 78 and the bonus lottery pattern table 50, and the lottery result is transmitted to each satellite.

The electronic display section 20 (see FIG. 1) is also connected to the main control CPU 80. Light emission of light emission unit of LEDs, etc., is controlled, whereby the decorative illumination is produced and predetermined text information, etc., is displayed in the electronic display section 20. Further, the amount of the JP of "MEGA" stored in a JP cumulative storage area 82E described later is displayed particularly in the JP amount display section 21 of the electronic display section 20. The amount of the JP displayed in the JP amount display section 21 is updated accordingly as the accumulated amount of the JP of "MEGA" varies. As the accumulated amount of each JP varies, the amount is also updated accordingly in the MINI indication part 43, the MAJOR indication part 44, and the MEGA indication part 45 in the BET screen 31.

Figure 11:
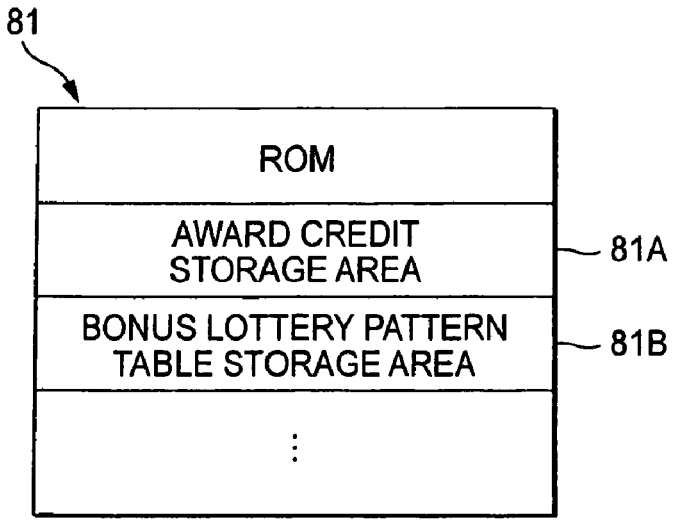
FIG. 11 is a schematic drawing to show storage areas of ROM of the roulette gaming machine according to the embodiment of the invention.

As shown in FIG. 11, the ROM 81 is provided with an award credit storage area 81A storing the odds concerning a roulette game using the BET screen 31 and a bonus lottery pattern table storage area 81B storing the bonus lottery pattern table 50 for determining whether or not a bonus game is to be generated after the expiration of the bet period, whether or not JP of bonus game is to be won, etc. As the odds for each BET area 42 of the BET screen 31 stored in the award credit storage area 81A, an award of "×2" to "×36" is previously determined and is stored depending on the bet method (straight up, corner bet, split bet, etc.,).

Figure 12:
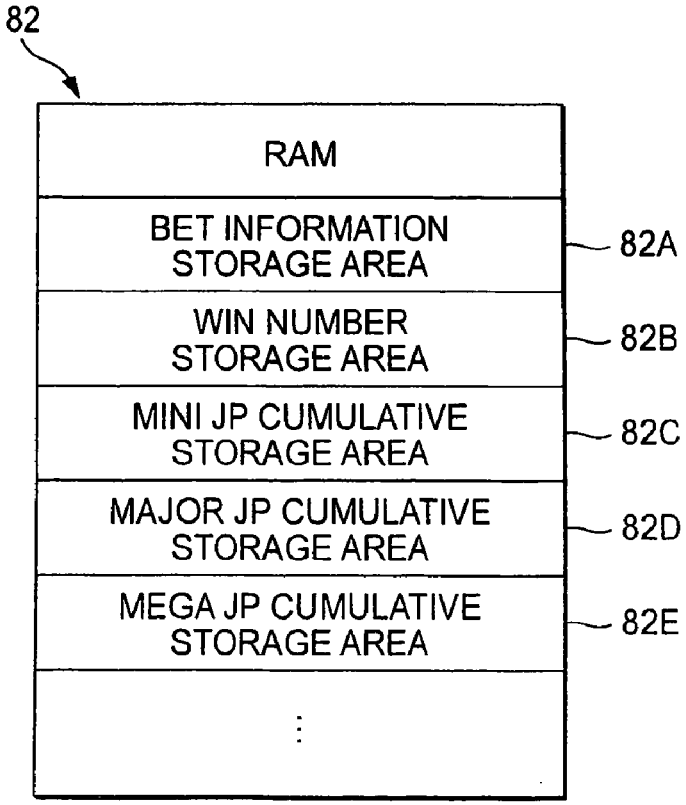
FIG. 12 is a schematic drawing to show storage areas of RAM of the roulette gaming machine according to the embodiment of the invention.

As shown in FIG. 12, the RAM 82 is provided with a bet information storage area 82A for storing the bet information of the player playing a game at present, a win number storage area 82B for storing the win number of the roulette unit 2 determined by the win determination unit 84, a JP cumulative storage area 82C for storing the credit count resulting from cumulatively adding 0.1% of the credit count bet on the BET screen 31 (see FIG. 3) as JP of "MINI," a JP cumulative storage area 82D for storing the credit count resulting from cumulatively adding 0.2% of the credit count bet on the BET screen 31 (see FIG. 3) as JP of "MAJOR," and the above-mentioned JP cumulative storage area 82E for storing the credit count resulting from cumulatively adding 0.5% of the credit count bet on the BET screen 31 (see FIG. 3) as JP of "MEGA." The bet information specifically is the BET areas 42 and the number of bet chips specified on the BET screen 31.

Figure 10:
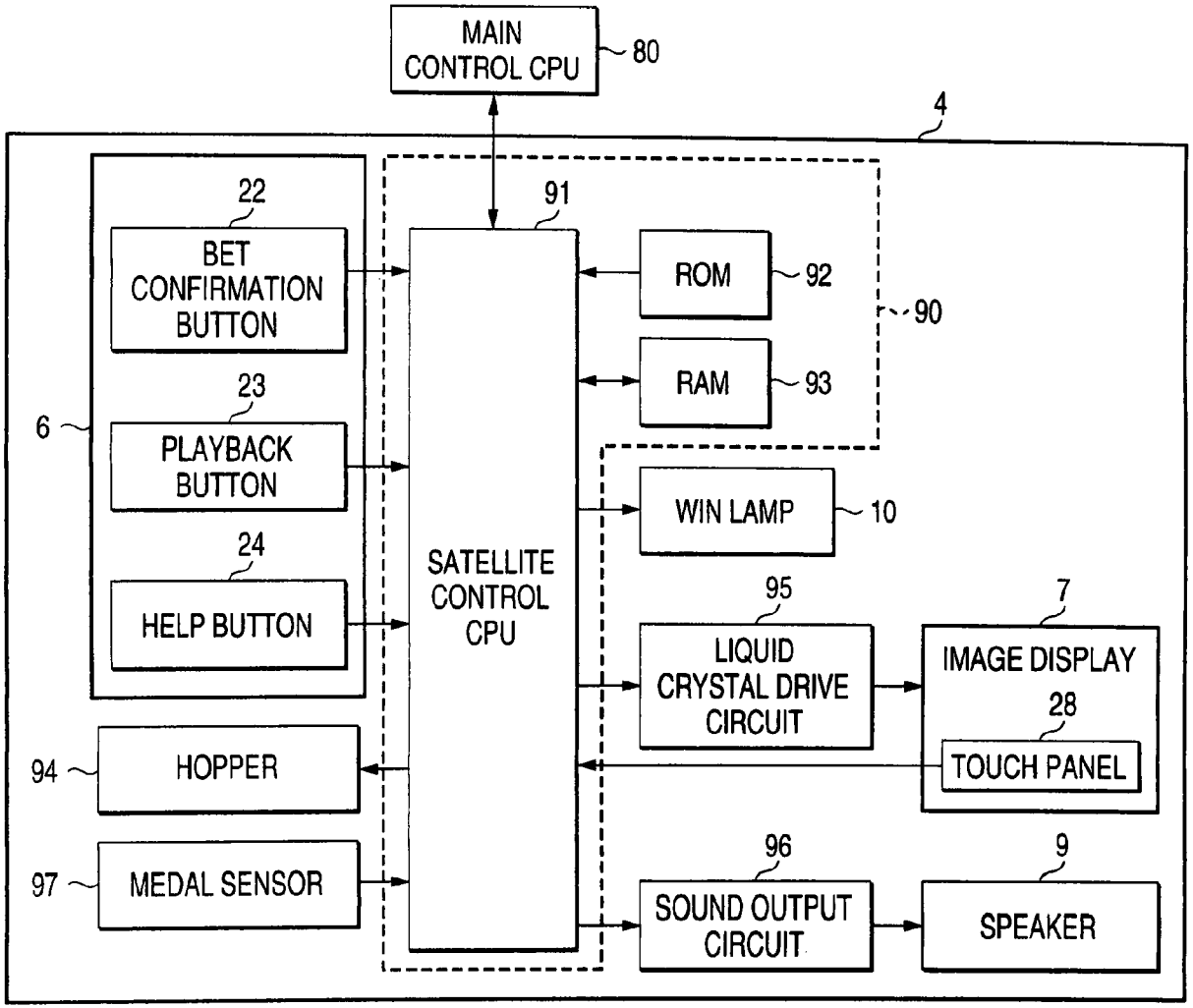
FIG. 10 is a block diagram to schematically show a control system of a satellite according to the embodiment of the invention.

Next, the configuration of the control system of the satellite 4 connected to the main control CPU 80 of the main control section 83 will be discussed based on FIG. 10. FIG. 10 is a block diagram to schematically show the control system of the satellite 4 according to the embodiment. The 12 satellites 4 basically have the same configuration and therefore in the description to follow, one satellite 4 is taken as an example.

The satellite 4 is made up of a satellite control section 90 and several peripheral devices. The satellite control section 90 is made up of a satellite control CPU 91, ROM 92, and RAM 93. The ROM 92 is implemented as semiconductor memory, etc., for example, and stores a program for providing the basic function of the satellite 4, various programs required for controlling the satellite 4, a data table, and the like. The RAM 93 is memory for temporarily storing various pieces of data on which operations are performed by the satellite control CPU 91, the current credit count owned by the player, the chip bet state of the player, and the like.

The BET confirmation button 22, the payback button 23, and the help button 24 placed on the control section 6 (see FIG. 1) are connected to the satellite control CPU 91. Based on an operation signal output as each button is pressed, etc., the satellite control CPU 91 controls the satellite to execute the corresponding operation. Specifically, the satellite control CPU 91 executes various types of processing based on an input signal supplied from the control section 6 in response to entry of operation of the player and the data and the programs stored in the ROM 92 and the RAM 93, and transmits the processing result to the main control CPU 80 of the main control section 83 described above.

On the other hand, the satellite control CPU 91 receives an instruction signal from the main control CPU 80 and controls the peripheral machines making up the satellite 4 for advancing the roulette game in the satellite 4. Depending on the processing, the satellite control CPU 91 executes various types of processing based on an input signal supplied from the control section 6 in response to entry of operation of the player and the data and the programs stored in the ROM 92 and the RAM 93, and controls the peripheral machines making up the satellite 4 for advancing the roulette game in the satellite 4. Which method the processing is to be performed according to is determined for each processing in response to the processing type. For example, medal payout processing responsive to the win number corresponds to the former type of processing and bet operation processing of the player on the BET screen 31 corresponds to the latter type of processing.

A hopper 94 is also connected to the satellite control CPU 91. The hopper 94 pays out a predetermined number of medals to the player from the medal payout opening 8 (see FIG. 1) in response to an instruction signal from the satellite control CPU 91.

Further, the image display 7 is connected via a liquid crystal drive circuit 95 to the satellite control CPU 91. The liquid crystal drive circuit 95 is made up of program ROM, image ROM, an image control CPU, work RAM, a VDP (video display processor), video RAM, etc. The program ROM stores an image control program and various selection tables concerning display on the image display 7. The image ROM stores dot data to form images displayed on the image display 7. The image control CPU determines the image to be displayed on the image display 7 from the dot data previously stored in the image ROM in accordance with the image control program previously stored in the program ROM based on a parameter set in the satellite control CPU 91. The work RAM is implemented as temporary storage unit for the image control CPU to execute the image control program. The VDP forms an image responsive to the display determined by the image control CPU and outputs the image to the image display 7. The video RAM is implemented as a temporary storage unit for the VDP to form an image.

The touch panel 28 is attached to the front of the image display 7 as mentioned above, and operation information of the touch panel 28 is transmitted to the satellite control CPU 91. Through the touch panel 28, the player bets chips on the BET screen 31 and selects cocktails from among the first cocktail 51 to the sixth cocktail 56 on the bonus game screen 33.

Specifically, the player operates the touch panel 28 in selecting the BET area 42, operating the unit BET button 36, and the like, and touch panel operation information is transmitted to the satellite control CPU 91. Based on the information, the current bet information of the player (the specified BET areas 42 and the number of bet chips) is stored in the RAM 93 whenever necessary. Further, the bet information is transmitted to the main control CPU 80 and is stored in the bet information storage area 82A of the RAM 82.

On the other hand, the player operates the touch panel 28 in selecting cocktails from among the first cocktail 51 to the sixth cocktail 56 on the bonus game screen 33, and touch panel operation information is transmitted to the satellite control CPU 91. Display control of changing each selected cocktail to a predetermined symbol 61 is performed based on the information and the lottery result using the bonus lottery pattern table 50 (see FIGS. 5 and 6).

The WIN lamp 10 is also connected to the satellite control CPU 91 and if a bonus game is generated at the satellite 4, the WIN lamp 10 is lighted in red. If the player wins a JP, the WIN lamp 10 is lighted in yellow.

Further, a sound output circuit 96 and the above-mentioned speaker 9 are connected to the satellite control CPU 91. The speaker 9 produces various effect sounds in making various effects based on output signals from the sound output circuit 96.

The above-mentioned medal sensor 97 is also connected to the satellite control CPU 91. The medal sensor 97 detects medals input through the medal insertion slot 5 (FIG. 1), calculates the number of the input medals, and transmits the result to the satellite control CPU 91. The satellite control CPU 91 increments the credit count of the player stored in the RAM 93 based on the transmitted signal.

If it is determined that a bonus game is generated according to a lottery held by the main control CPU 80, a bonus game is generated at the corresponding satellite 4 after reception of the determination result, and the two symbols 61 previously determined by a lottery held by the main control CPU 80 are displayed in the bonus game. Then, the JP win result is displayed and if the player wins, the credit cumulatively stored in the won JP is paid out to the player. The specific control executed by the main control CPU 80 and the satellite control CPU 91 is described later in detail using flowcharts.

Figure 13:
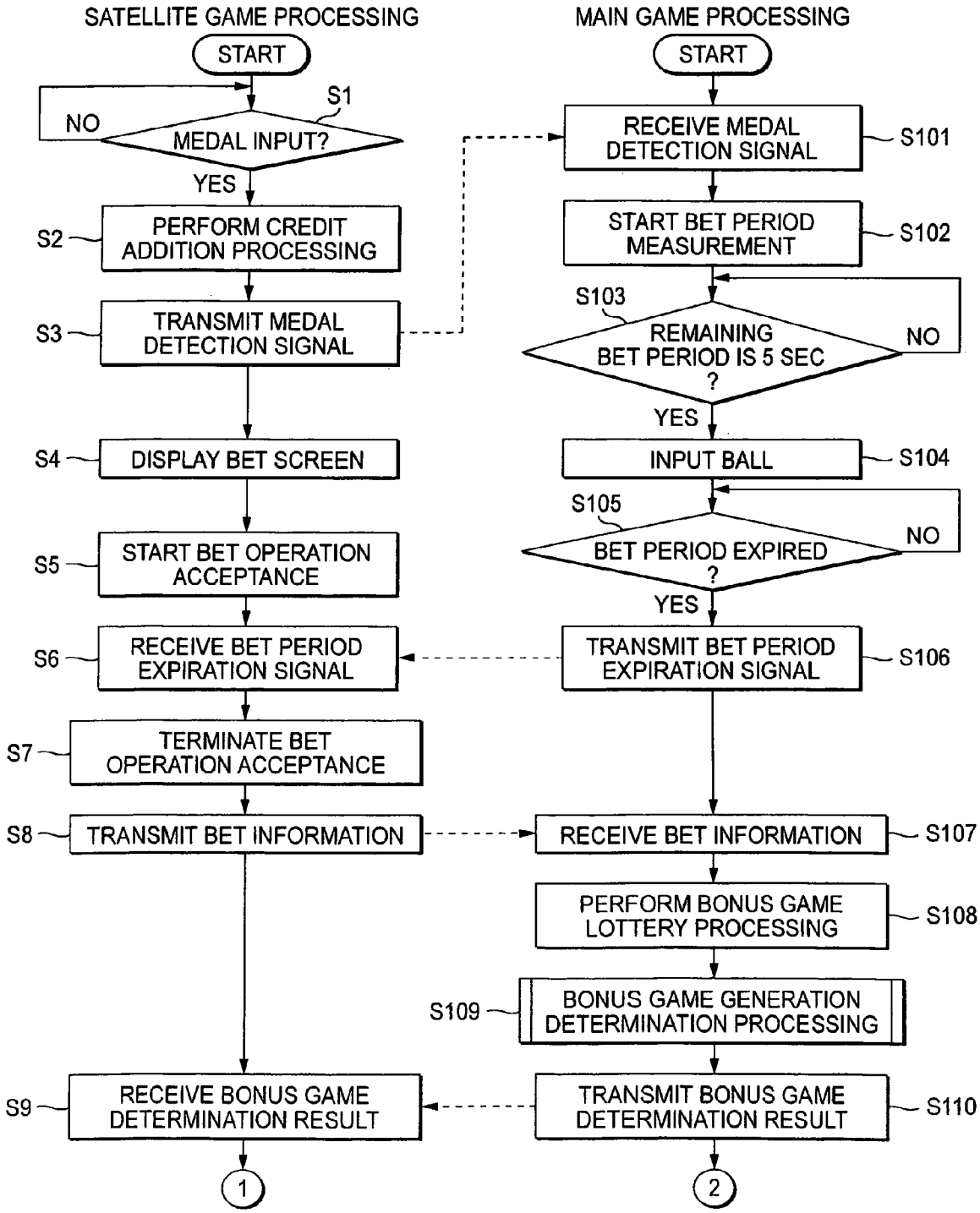
FIG. 13 is a flowchart of a game processing program of the roulette gaming machine according to the embodiment of the invention.
Figure 14:
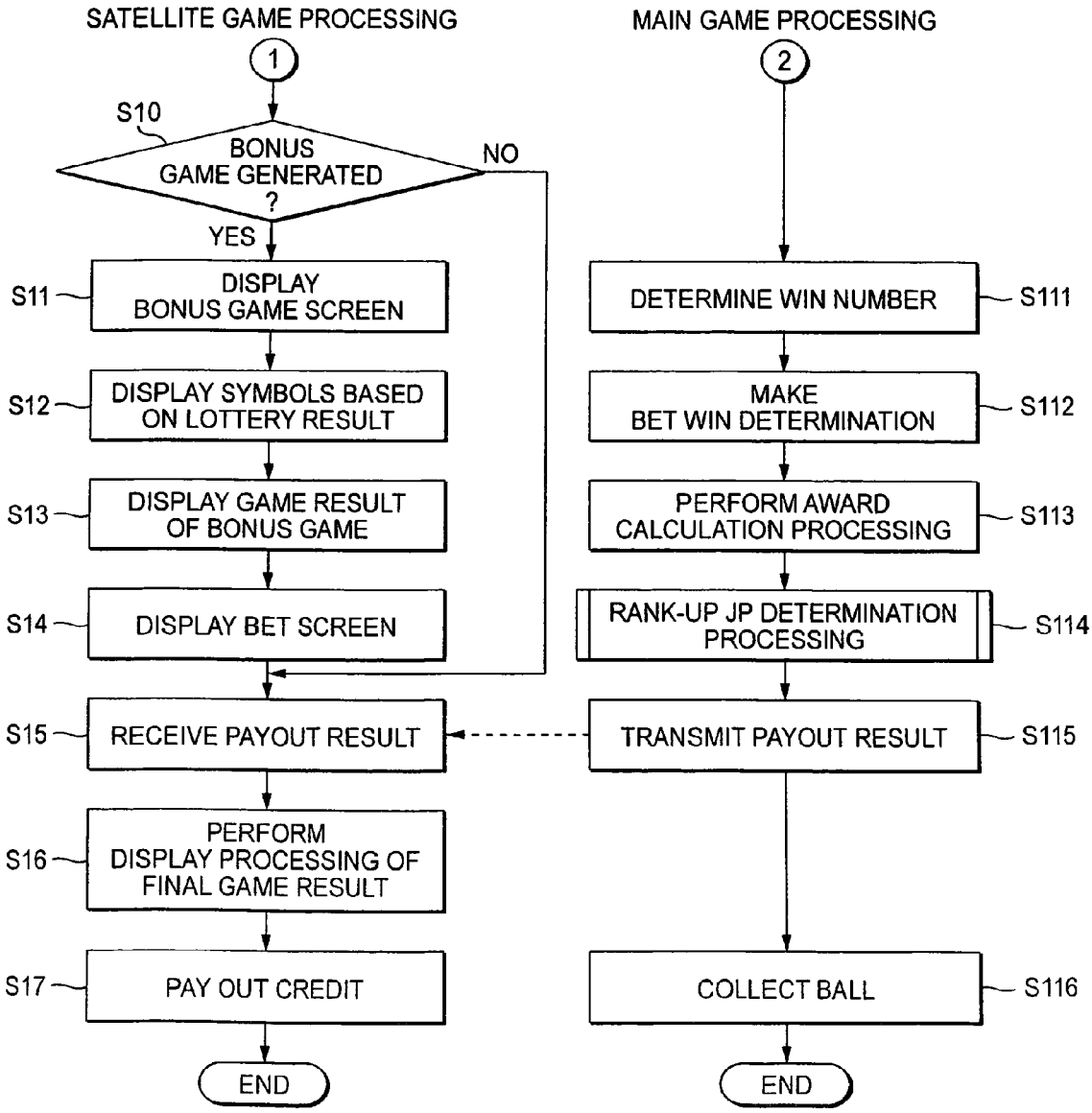
FIG. 14 is a flowchart of the game processing program of the roulette gaming machine according to the embodiment of the invention.

Subsequently, a main game processing program executed by the main control CPU 80 in the roulette gaming machine 1 and a satellite game processing program executed by the satellite control CPU 91 in the satellite 4 will be discussed based on FIGS. 13 and 14. The programs shown in the flowcharts of FIGS. 13 and 14 are stored in the ROM 81 and the RAM 82 included in the roulette gaming machine 1 and the ROM 92 and the RAM 93 included in the satellite 4 and are executed by the main control CPU 80 and the satellite control CPU 91.

First, the satellite game processing program will be discussed based on FIGS. 13 and 14. At step 1 (S1), the satellite control CPU 91 determines whether or not the player inputs a medal or a coin based on a detection signal of the medal sensor 97. If a medal or a coin is not input (NO at S1), a wait mode is entered until a coin is input; if a medal or a coin is input (YES at S1), the process goes to S2.

At S2, the credit data of the amount responsive to the number of input medals or coins is recorded in the RAM 93. Subsequently, at S3, a medal input signal indicating medal or coin input is transmitted to the main control section 83.

At S4, the BET screen 31 shown in FIG. 3 is displayed on the image display 7 of the satellite 4 and the bet period during which the player can bet a chip is started (S5). Each player participating in a game can operate the touch panel 28 to bet his or her chip on the BET area 42 relevant to his or her predicted number during the bet period making it possible to accept bet (see FIG. 3). The specific bet method using the BET screen 31 is previously described and therefore will not be discussed again.

Any other player can participate in the game in the course thereof and the roulette gaming machine 1 according to the embodiment allows a maximum of 12 players to play a game. Further, if the current game is played successively following the preceding game, bet operation acceptance is started immediately after the preceding game is over.

Upon reception of a bet period expiration signal indicating the bet period has expired at S6 from the main control CPU 80, an image indicating that the bet period has expired is displayed on the liquid crystal screen 29 of the satellite 4 and the bet operation acceptance through the touch panel 28 is terminated (S7). Then, bet information of the player at the satellite 4 (the specified BET area 42 and the number of chips bet on the specified BET area 42) is transmitted (S8).

At S9, the determination result of bonus game lottery processing (S108) and bonus game generation determination processing (S109) described later, executed by the main control CPU 80 is received from the main control CPU 80. The bonus game determination result received from the main control CPU 80 is made up of (1) determination as to whether or not a bonus game is to be generated at the satellite, (2) the types of symbols 61 when cocktails are selected on the bonus game screen 33 if a bonus game is to be generated, (3) the win result of the bonus game indicating which JP is won, and the like (see FIG. 8).

Next, the satellite control CPU 91 at S10 in FIG. 14 determines whether or not a bonus game is to be generated based on the determination result of the bonus game generation determination processing received at S9. If it is determined that a bonus game is not to be generated at the satellite 4 (NO at S10), the process goes to S15.

On the other hand, if it is determined that a bonus game is not to be generated at the satellite 4 (YES at S10), the bonus game screen 33 shown in FIG. 4 is displayed at S11. Display processing of changing the selected cocktails to any of the symbols 61A to 61E (see FIG. 7) previously determined according to the bonus lottery pattern table 50 in the selection order of the cocktails based on the cocktail selection operation from among the first cocktail 51 to the sixth cocktail 56 by the player and the determination result of the bonus game generation determination processing received at S9 is performed (S12). However, when the remaining time of the bonus game reaches "0," if selection of two symbols by the player is not complete, the remaining cocktail or cocktails are selected at random and the cocktails are changed to any of the symbols 61A to 61E (see FIG. 7). The specific cocktail selection processing from among the first cocktail 51 to the sixth cocktail 56 and the specific display processing of the symbols 61A to 61E are previously described with reference to FIGS. 4 to 6 and therefore will not be discussed again.

Figure 17:
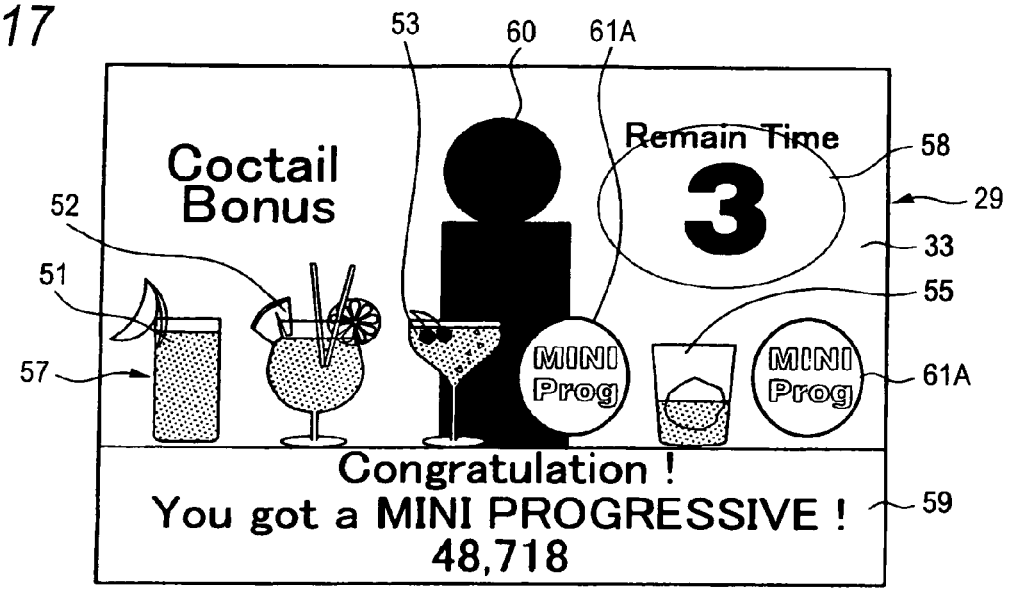
FIG. 17 is a schematic representation to show the bonus game screen when the game result of a bonus game indicating that JP of "MINI" is won is displayed.
Figure 18:
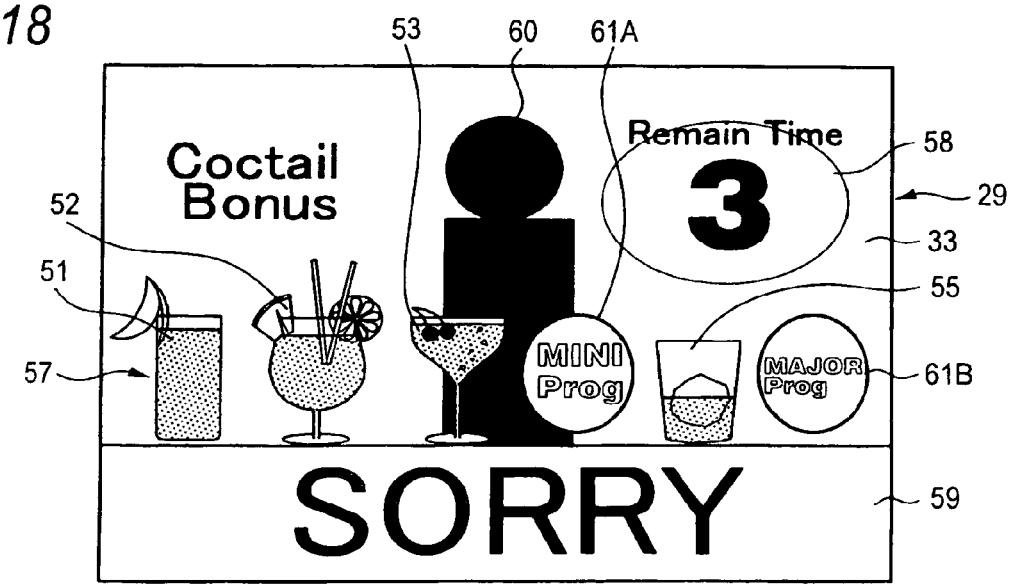
FIG. 18 is a schematic representation to show the bonus game screen when the game result of a bonus game indicating a losing is displayed.
Figure 19:
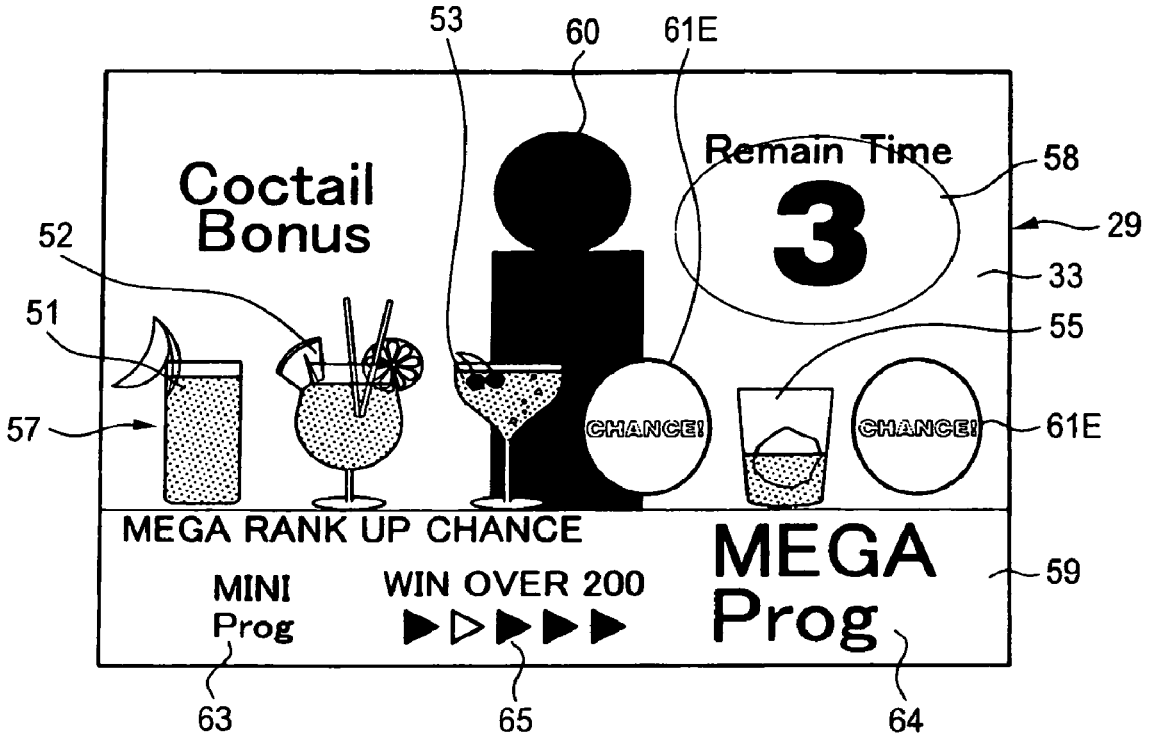
FIG. 19 is a schematic representation to show the bonus game screen when the game result of a bonus game indicating that "rank-up JP" is won is displayed.

At S13, the game result of the bonus game is displayed. FIGS. 17 to 19 are drawings to show examples of the liquid crystal screen 29 when the game result of the bonus game is displayed at S13. FIG. 17 shows the bonus game screen 33 when the player wins JP of "MINI," for example, and a message to the effect that the player wins JP of "MINI" and the credit count of JP of "MINI" at the time are displayed in the comment display section 59. FIG. 18 shows the bonus game screen 33 when the player loses, for example, and a message to the effect that the player cannot gain any JP is displayed in the comment display section 59. FIG. 19 shows the bonus game screen 33 when the player wins "rank-up JP," for example, and a message to the effect that the player wins "rank-up JP" is displayed in the comment display section 59.

The bonus game screen 33 particularly displayed when the player wins "rank-up JP" will be discussed. A character string 63 of "MINI Prog," a character string 64 of "MEGA Prog," and a triangle group 65 displayed as animation as it proceeds from the left to the right between the character strings are displayed in the comment display section 59. A comment to the effect that if the player gains an award of 200 credit points or more in the current base game (roulette game using the BET screen 31), the rank is up from JP of "MINI" to JP of "MEGA" is displayed above the triangle group 65.

Figure 20:
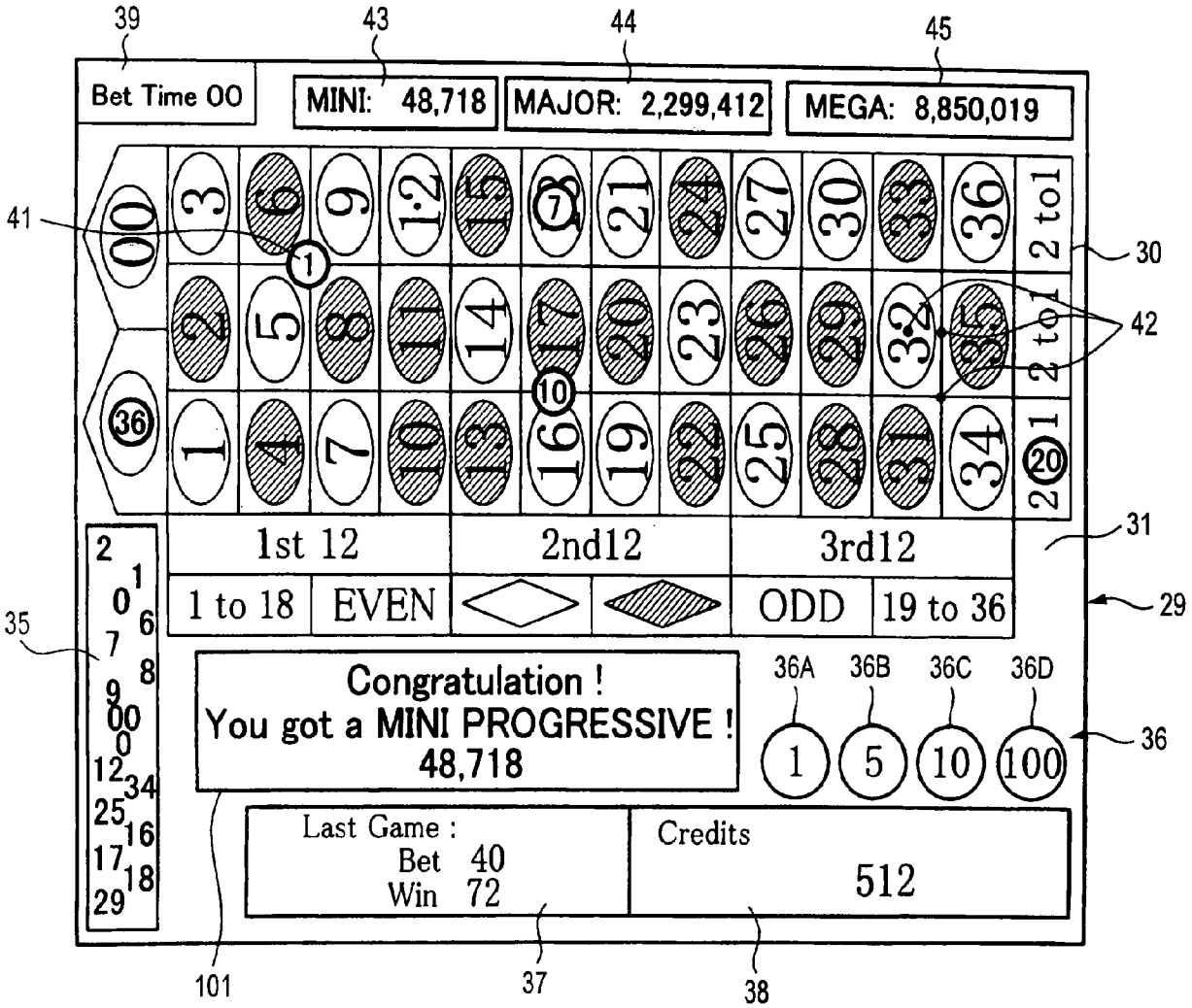
FIG. 20 is a drawing to show the BET screen when the game result of a bonus game indicating that JP of "MINI" is won is displayed.
Figure 21:
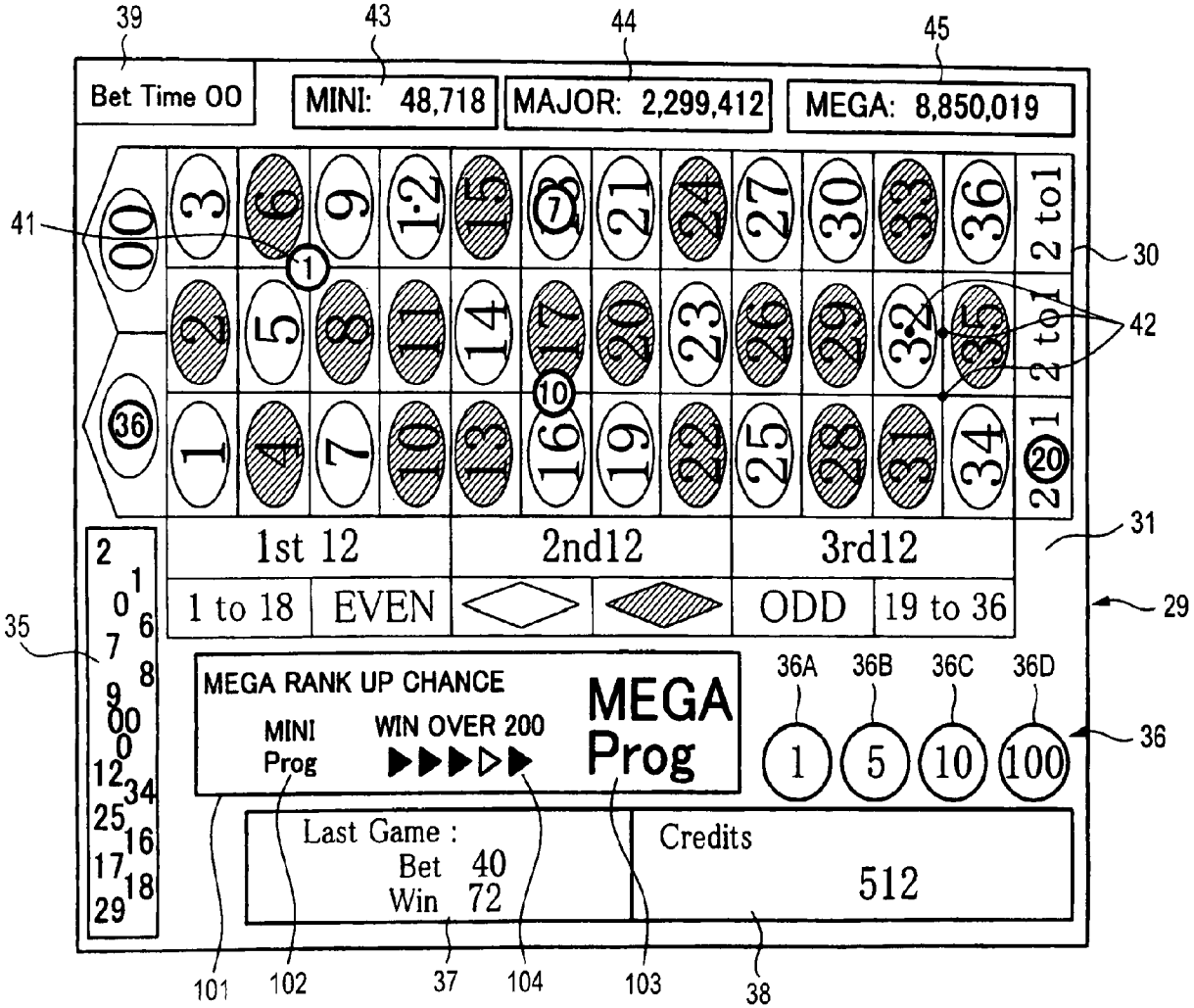
FIG. 21 is a drawing to show the BET screen when the game result of a bonus game indicating that "rank-up JP" is won is displayed.

Subsequently, at S14, the display of the liquid crystal screen 29 is switched from the bonus game screen 33 to the BET screen 31 as the bonus game is over, and again the BET screen 31 (FIG. 3) is displayed. FIGS. 20 and 21 are drawings to show examples of the liquid crystal screen 29 when the BET screen 31 is again displayed at S14. FIG. 20 shows the BET screen 31 after the player wins JP of "MINI" in the generated bonus game, for example, and a message to the effect that the player wins JP of "MINI" and the credit count of JP of "MINI" at the time are displayed in a bonus game result display section 101.

FIG. 21 shows the BET screen 31 after the player wins "rank-up JP" in the generated bonus game, for example, and a message to the effect that the player wins "rank-up JP" is displayed in the bonus game result display section 101. Specifically, a character string 102 of "MINI Prog," a character string 103 of "MEGA Prog," and a triangle group 104 displayed as animation as it proceeds from the left to the right between the character strings are displayed. A comment to the effect that if the player gains an award of 200 credit points or more in the current base game (roulette game using the BET screen 31), the rank is up from JP of "MINI" to JP of "MEGA" is displayed above the triangle group 104.

If a bonus game is not generated (NO at S10), the bonus game result display section 101 is not displayed and the usual BET screen 31 shown in FIG. 3 is continuously displayed.

Then, the ball 16 rolling in the roulette unit 2 is housed in the ball housing groove 13 and the main control CPU 80 determines the win number (any number of 1 to 36, 0, 00) (S111) and makes win determination (S112). At S15, the credit payout result transmitted from the main control CPU 80 is received. The credit payout result is made up of the payout result of the usual roulette game played using the BET screen and the JP payout result based on the bonus game.

Figure 22:
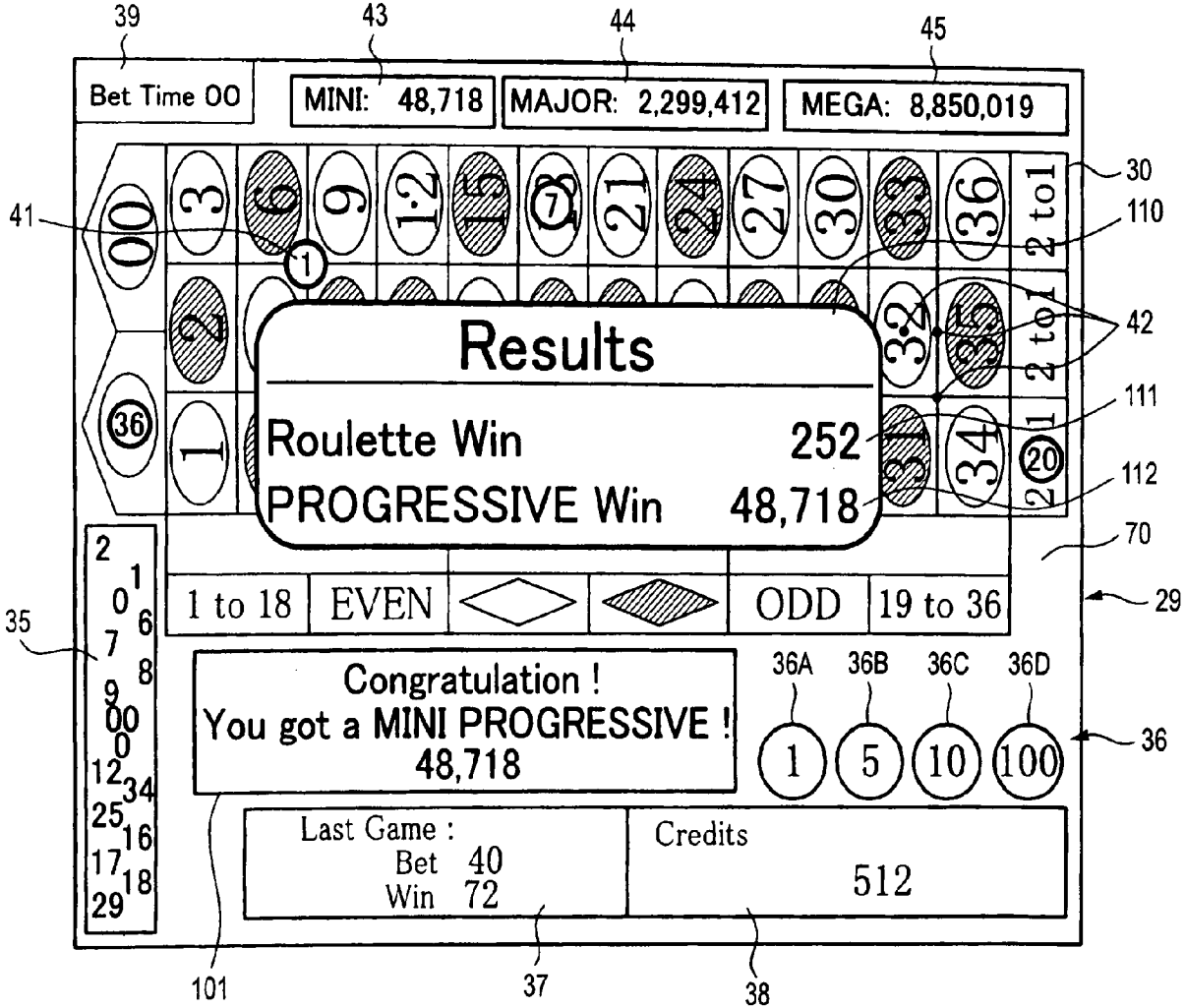
FIG. 22 is a drawing to show the final game result screen when JP of "MINI" is won in the bonus game.
Figure 23:
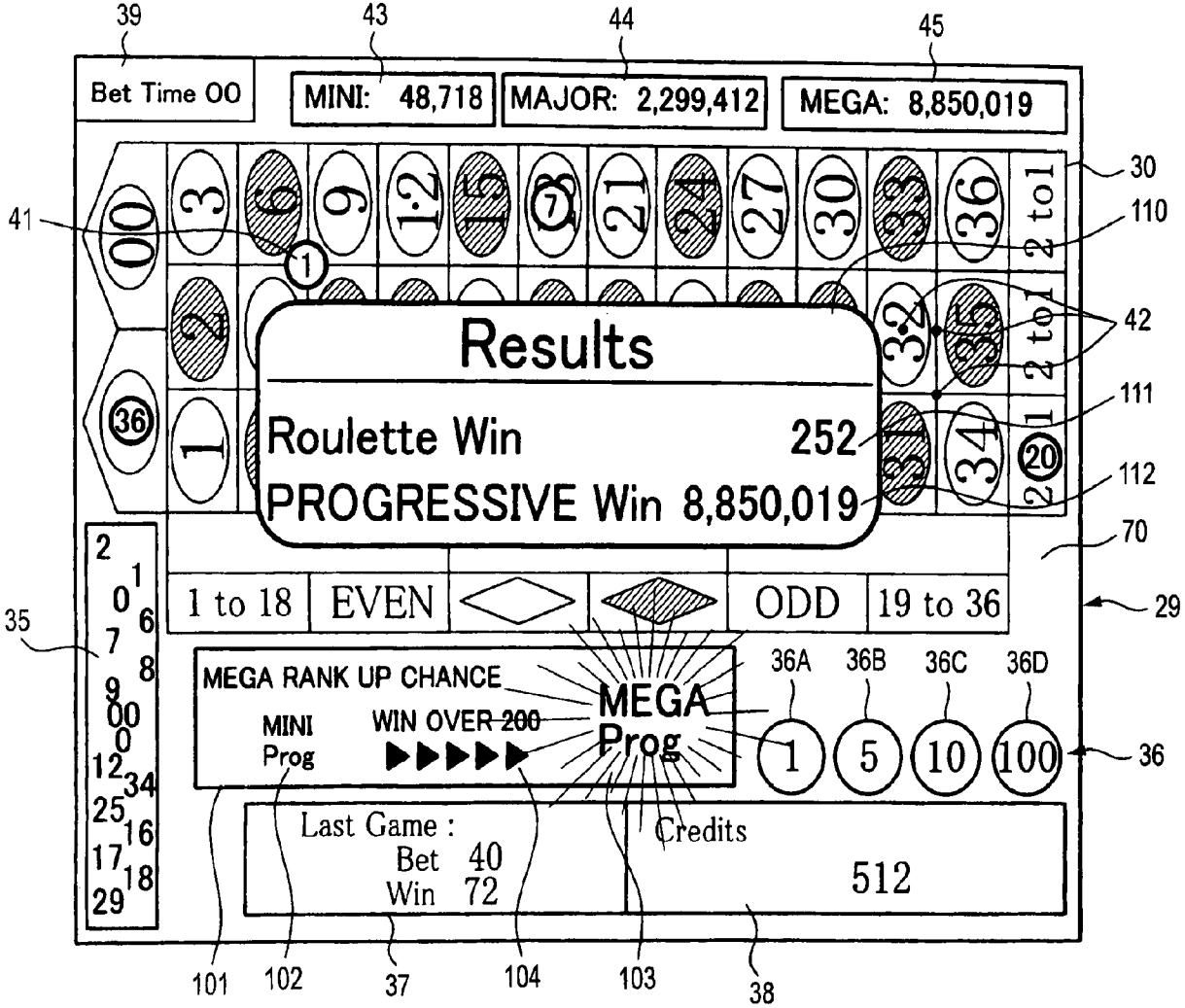
FIG. 23 is a drawing to show the game result screen when the player wins "rank-up JP" in a bonus game and wins "rank-up JP" with rank up to JP of "MEGA;"
Figure 24:
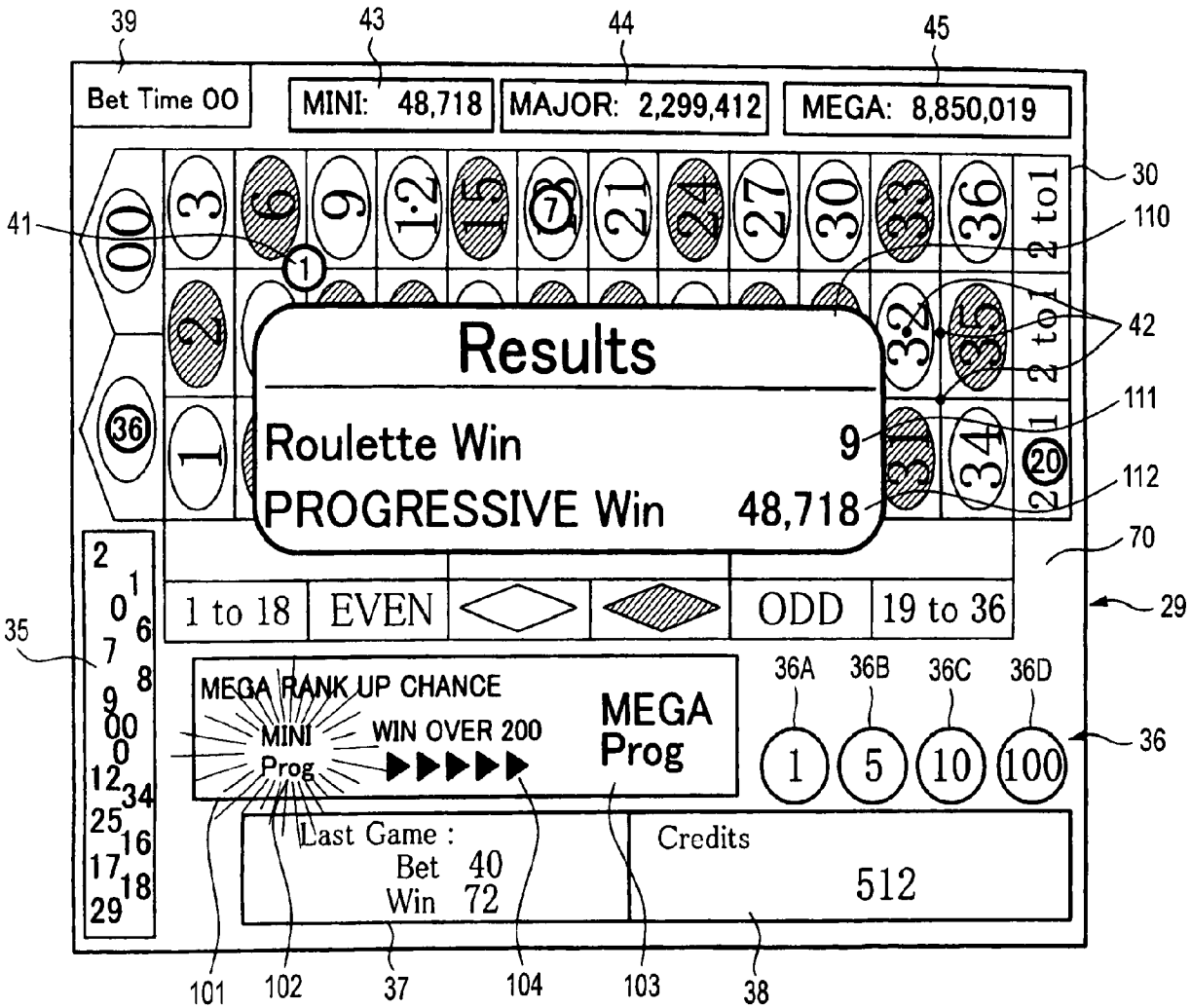
FIG. 24 is a drawing to show the game result screen when the player wins "rank-up JP" in a bonus game and wins JP of "MINI" without rank up.

Next, at S16, a game result screen 70 indicating the final game result is displayed based on the payout result received at S15. FIGS. 22 to 24 are drawings to show the liquid crystal screen 29 when the final game result screen 70 is displayed at S16.

FIG. 22 shows the game result screen 70 when the player wins JP of "MINI" and obtains an award of 252 credit points as the win number of the roulette game becomes 18, for example, and a final game result display section 110 is displayed in addition to the bonus game result display section 101 displayed at S14.

The final game result display section 110 is made up of a usual gained credit count display section 111 for displaying the credit count gained by playing a roulette game of a base game and a special gained credit count display section 112 for displaying the credit count gained by playing a bonus game; adding together the credit counts in the display sections 111 and 112 results in the finally gained credit count by the player in the current game.

FIG. 23 shows the game result screen 70 when the player wins "rank-up JP" and obtains an award of 252 credit points as the win number of the roulette game becomes 18, for example. At the time, the bonus game result display section 101 informs the player by lighting the character string 103 of "MEGA Prog" that the player wins with the rank up (changed) from JP of "MINI" to JP of "MEGA" as the player obtains an award of 200 credit points or more in the roulette game. The current credit count of JP of "MEGA" is displayed in the special gained credit count display section 112.

FIG. 24 shows the game result screen 70 when the player wins "rank-up JP" and obtains an award of nine credit points as the win number of the roulette game becomes 6, for example. At the time, the bonus game result display section 101 informs the player by lighting the character string 102 of "MINI Prog" that the player wins JP of "MINI" without rank up (being changed) to JP of "MEGA" as the player obtains an award of less than 200 credit points in the roulette game. The current credit count of JP of "MINI" is displayed in the special gained credit count display section 112.

Then, at S17, the credit is paid out based on the payout result received at S15. Specifically, the credit data of the amount responsive to the award of the roulette game of a base game and the credit count of the won JP if a bonus game is generated and JP is won is recorded in the RAM 93. If the player presses the payback button 23, as many medals as the number indicated by the current credit count stored in the RAM 93 (usually one medal per credit point) are paid back from the medal payout opening 8.

Then, if the player at any satellite 4 continues to play a game, the process returns to S4 and again the bet period is started and a transition is made to another game.

On the other hand, if the game is over at all satellites 4, the roulette game processing is terminated.

Next, the main game processing program will be discussed based on FIGS. 13 and 14. At S101, the main control CPU 80 receives the medal detection signal transmitted from the satellite control CPU 91 at S3 and determines whether or not the player inputs a medal or a coin. In the roulette gaming machine 1 according to the embodiment, if a medal or a coin is input at any satellite 4, a medal input signal is sent from the satellite control CPU 91 of the satellite 4 where the medal or the coin is input to the main control CPU 80.

Measurement of the bet period of the acceptance period during which the player can bet a chip is started (S102) from the point in time when the first player participating in the game inputs a medal or a coin. If the current game is played successively following the preceding game, the bet period is started immediately after the preceding game is over. Each player participating in the game can operate the touch panel 28 to bet his or her chip on the BET area 42 relevant to his or her predicted number during the bet period.

Next, whether or not the remaining time of the bet period becomes five seconds is determined at S103. The remaining bet period is also displayed in the BET time indication part 39 of the liquid crystal screen 29 (see FIG. 3). If it is determined that the remaining bet time does not reach five seconds (NO at S103), standby mode is continued until the remaining bet period becomes five seconds. On the other hand, if it is determined that the remaining bet time is five seconds (YES at S103), lottery processing of the roulette unit 2 is executed in accordance with a game execution program as follows:

Specifically, first the ball input unit 85 is driven for inputting the ball 16 into the roulette wheel (S104). The input ball 16 rolls on the top of the roulette wheel along the guide wall 18 and then when the rotation speed of the ball 16 reduces and the ball 16 loses the centrifugal force, the ball 16 rolls down the slope of the frame 11 to the inside and arrives at the rotating rotation disk 12 (see FIG. 2).

The ball 16 rolling to the rotation disk 12 is housed in any ball housing groove 13 through the tops of the number indication plates 14 outside the rotating rotation disk 12, and the number described on the number indication plate 14 corresponding to the ball housing groove 13 in which the ball 16 is housed (any number of 1 to 36, 0, 00) becomes the win number. The win number is determined at S111 described later.

At S105, whether or not the bet period expires is determined. If it is determined that the bet period does not expire (NO at S105), standby mode is continued until the bet period expires. On the other hand, if it is determined that the bet period expires (YES at S105), a bet period expiration signal indicating the bet period has expired is transmitted to the satellite control CPU 91 at S106.

Next, at S107, bet information of the player at each satellite 4 (the specified BET area 42 and the number of chips bet on the specified BET area 42) is received and is stored in the bet information storage area 82A of the RAM 82.

Next, at S108, the main control CPU 80 acquires the random number from the random number sampling circuit 78 and performs a lottery concerning generation of a bonus state for each satellite 4 based on the bonus lottery pattern table 50 stored in the bonus lottery pattern table storage area 81B. Specifically, in the roulette gaming machine 1 according to the embodiment, 12 random numbers in a one-to-one correspondence with the 12 satellites 4 are acquired and the lottery result of (1) determination as to whether or not a bonus game is to be generated, (2) the types of symbols 61 when cocktails are selected on the bonus game screen 33 if a bonus game is to be generated, (3) which JP is won, and the like is determined at each satellite 4 based on the bonus lottery pattern table 50 (see FIG. 8).

Figure 15:
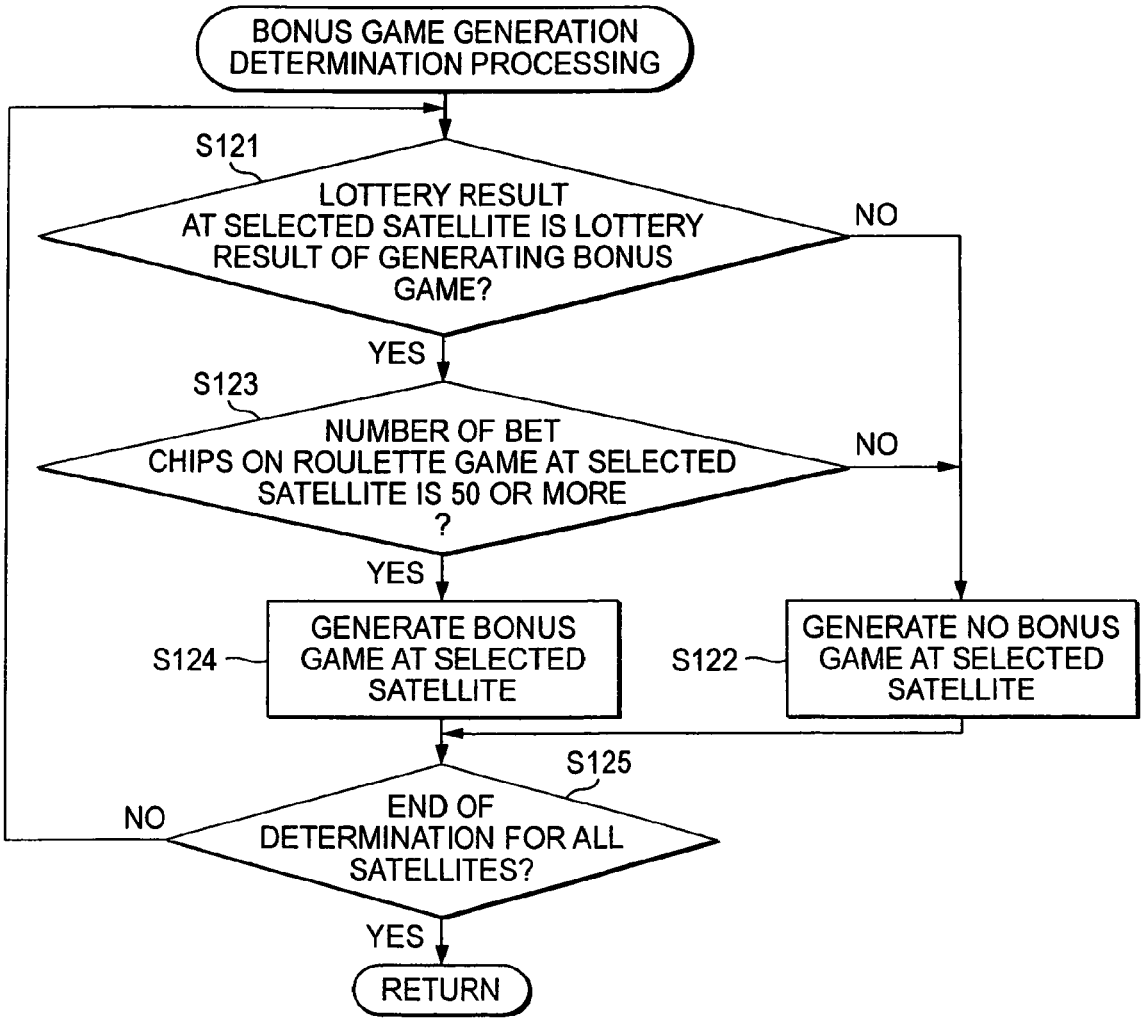
FIG. 15 is a flowchart of a subroutine program of bonus game generation determination processing of the roulette gaming machine according to the embodiment of the invention.

Further, at s109, the bonus game generation determination processing in FIG. 15 to determine whether or not a bonus game is to be generated at each satellite 4 is performed based on the lottery result of the lottery processing at S108 and the bet information received at S107. The specific description of the bonus game generation determination processing is given later.

Subsequently, at S110, the bonus game determination result concerning the bonus game indicating (1) determination as to whether or not a bonus game is to be generated, (2) the types of symbols 61 when cocktails are selected on the bonus game screen 33 if a bonus game is to be generated, and (3) which JP is won for each satellite 4 based on the determination processing at S109 is transmitted to the satellite control CPU 91.

At S111, after the ball 16 is housed in the ball housing groove 13, the main control CPU 80 drives the win determination unit 84 to determine the number corresponding to the ball housing groove 13 in which the ball 16 is housed.

Further, at S112, whether or not the bet chip at each satellite 4 is a win chip is determined from the bet information at each satellite 4 received at S107 and the win number determined at S111.

Subsequently, the main control CPU 80 executes award calculation processing (S113). In the award calculation processing, the win chip is recognized for each satellite 4 and the odds (the credit count paid out per chip) for each BET area 42 stored in the award credit storage area 81A of the ROM 81 are used to calculate the total of the award amounts of credit paid out to each satellite 4.

Figure 16:
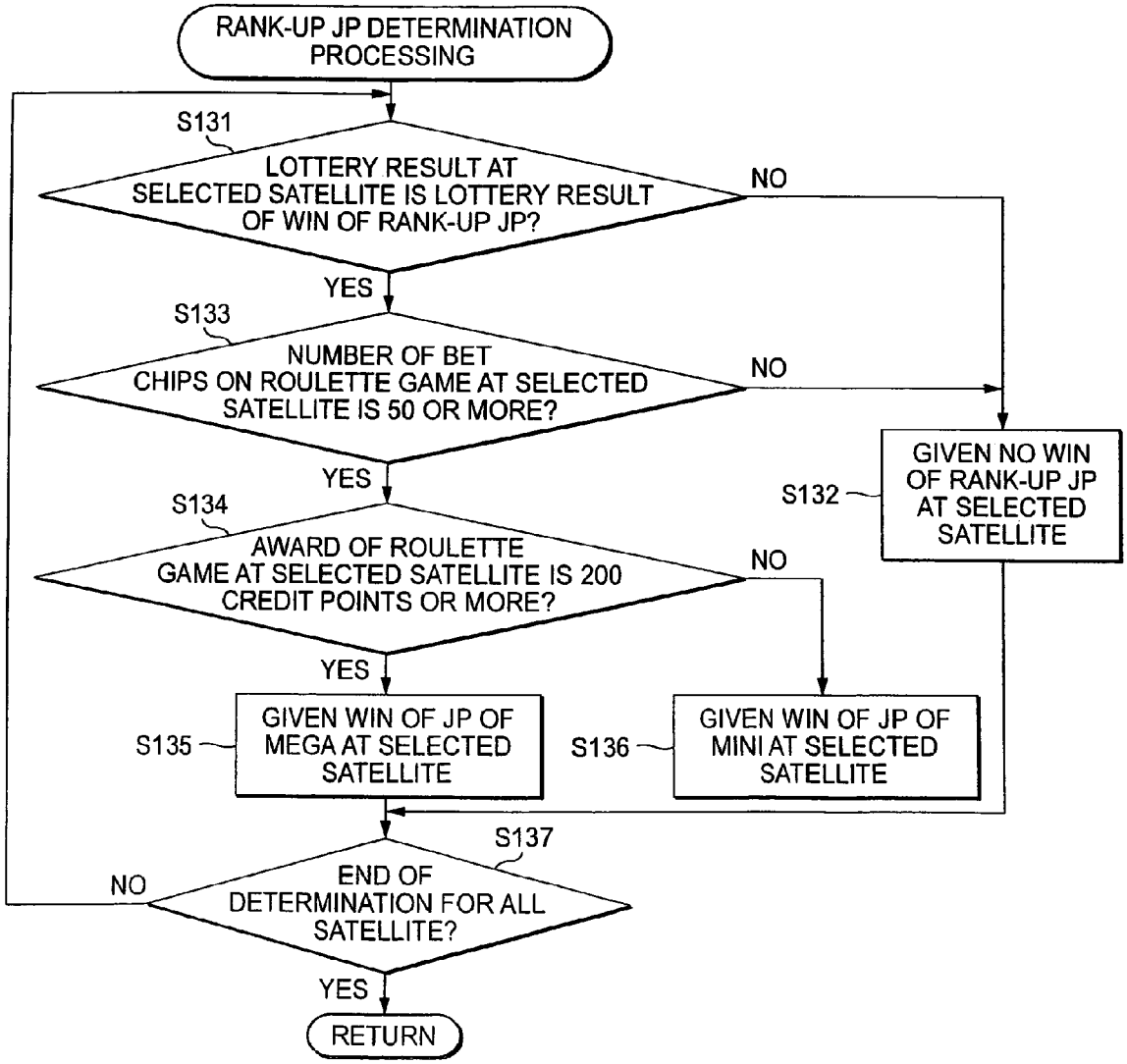
FIG. 16 is a flowchart of a subroutine program of rank-up JP determination processing of the roulette gaming machine according to the embodiment of the invention.

Further, at S114, the rank-up JP determination processing in FIG. 16 is performed to determine whether or not JP of "MINI" is to be ranked up to JP of "MEGA" if the player wins "rank-up JP".

At S115, the main control CPU 80 executes transmission processing of the payout result of credit of the roulette game based on the award calculation processing at S113 and the payout result of credit of the bonus game based on the win determination of the bonus game at S108 and S109. Specifically, the credit data corresponding to the award amounts of the roulette game of a base game and the bonus game is output to the satellite control CPU 91 of the satellite winning the game.

Then, at S116, the ball collection unit 86 provided below the rotation disk 12 is driven for collecting the ball 16 on the rotation disk 12. The collected ball 16 will be again input into the roulette wheel of the roulette unit 2 in the following game.

Next, the subroutine of the bonus game generation determination processing at S109 will be discussed. FIG. 15 is a flowchart to show the subroutine of the bonus game generation determination processing executed by the main control CPU 80 of the roulette gaming machine 1 according to the embodiment.

First, at S121, the main control CPU 80 selects one satellite 4 from among the 12 satellites 4 and determines whether or not the lottery result of a bonus game at S108 at the selected satellite 4 is the lottery result of generating a bonus game. In the roulette gaming machine 1 according to the embodiment, a lottery is held based on the random number sampled in the random number sampling circuit 78 and the bonus lottery pattern table 50 (see FIG. 8) and if the random number is in the range of 0 to 26667, the lottery result becomes the lottery result of generating a bonus game, as described above.

If it is determined that the lottery result is the lottery result of generating no bonus game (NO at S121), namely, if the acquired random number is in the range of 26668 to 8388607, it is determined that no bonus game is to be generated at the selected satellite 4 (S122) and then the process goes to S125.

On the other hand, if it is determined that the lottery result is the lottery result of generating a bonus game (YES at S121), namely, if the acquired random number is in the range of 0 to 26667, the process goes to S123 and whether or not the number of bet chips on the roulette game of a base game at the selected satellite 4 is 50 or more is determined based on the bet information received at S107.

If it is determined that the number of bet chips is less than 50 (NO at S123), it is determined that no bonus game is to be generated at the selected satellite 4 (S122) and then the process goes to S125. In contrast, if it is determined that the number of bet chips is 50 or more (YES at S123), it is determined that a bonus game is to be generated at the selected satellite 4 (S124) and then the process goes to S125.

At S125, whether or not the determination at S122 or S124 has been made for all 12 satellites 4 is determined. If it is determined that the determination is not yet complete for all satellites 4 (NO at S125), the process returns to S121 and the bonus game generation determination processing is performed for the remaining satellite 4. On the other hand, if it is determined that the determination is complete for all satellites 4 (YES at S125), the bonus game generation determination processing is exited to the main routine (S110).

Next, the subroutine of the rank-up JP determination processing at S114 will be discussed. FIG. 16 is a flowchart to show the subroutine of the rank-up JP determination processing executed by the main control CPU 80 of the roulette gaming machine 1 according to the embodiment.

First, at S131, the main control CPU 80 selects one satellite 4 from among the 12 satellites 4 and determines whether or not the lottery result of a bonus game at S108 at the selected satellite 4 is the lottery result of win of "rank-up JP." In the roulette gaming machine 1 according to the embodiment, a lottery is held based on the random number sampled in the random number sampling circuit 78 and the bonus lottery pattern table 50 (see FIG. 8) and if the random number is in the range of 0 to 8, the lottery result becomes the lottery result of win of "rank-up JP," as described above.

If it is determined that the lottery result is the lottery result of no win of "rank-up JP" (NO at S131), namely, if the acquired random number is in the range of 9 to 8388607, it is determined that the player does not win rank-up JP at the selected satellite 4 (S132) and then the process goes to S137.

On the other hand, if it is determined that the lottery result is the lottery result of win of "rank-up JP" (YES at S131), namely, if the acquired random number is in the range of 0 to 8, the process goes to S133 and whether or not the number of bet chips on the roulette game of a base game at the selected satellite 4 is 50 or more is determined based on the bet information received at S107.

If it is determined that the number of bet chips is less than 50 (NO at S133), it is determined that the player does not win rank-up JP at the selected satellite 4 (S132) and then the process goes to S137. In contrast, if it is determined that the number of bet chips is 50 or more (YES at S133), subsequently whether or not the award of the roulette game of a base game at the selected satellite 4 is 200 credit points or more is determined based on the result of the award calculation processing at S113 (S134).

If it is determined that the award of the roulette game at the selected satellite 4 is 200 credit points or more (YES at S134), it is determined that the player wins JP of "MEGA" ranked up (changed) from JP of "MINI" (S135) and then the process goes to S137. In contrast, if it is determined that the award of the roulette game at the selected satellite 4 is less than 200 credit points (NO at S134), it is determined that the player wins JP of "MINI" not ranked up (changed) to JP of "MEGA" (S136) and then the process goes to S137.

At S137, whether or not the determination at S132, S135, or S136 has been made for all 12 satellites 4 is determined. If it is determined that the determination is not yet complete for all satellites 4 (NO at S137), the process returns to S131 and the rank-up JP determination processing is performed for the remaining satellite 4. On the other hand, if it is determined that the determination is complete for all satellites 4 (YES at S137), the rank-up JP determination processing is exited to the main routine (S115).

As described above, in the roulette gaming machine 1 according to the embodiment, a lottery as to whether or not a bonus game is to be generated is held after the expiration of the bet period of a roulette game of a base game using the BET screen 31 (S108) and a lottery is held as to whether or not the player wins any JP of "MINI," "MAJOR," "MEGA," or "rank-up JP" in the bonus game (S108) and the credit corresponding to the won JP is paid out (S17), so that it is made possible to allow another player to hold a sense of anticipation of winning another JP and continue to play a game still after one player wins any one JP.

If the lottery result becomes the lottery result of generating a bonus game in the bonus game lottery processing, a bonus game is not generated unless the number of bet chips on a roulette game of a base game is 50 or more. Thus, it is not feared that a bonus game may be generated at the satellite 4 where no player plays a game, and it is made possible to allow the player to bet a larger number of chips on a roulette game for promoting game play wish.

Further, if the player wins rank-up JP, win of JP of "MINI" is guaranteed for the player and if the player gains an award of 200 credit points or more in the roulette game, the win is changed to win of JP of "MEGA" giving a higher award (S135). Thus, the game result of the bonus game is changed based on the game result of the roulette game of a base game, whereby the player is provided with versatile game plays including the base game and the bonus game in association with each other and the sense of anticipation of the player for the game results of the roulette game and the bonus game is more promoted. Since the game result of the bonus game is changed based on the game result of the roulette game played by the player, the sense of accomplishment of the player for the game play is promoted.

Since the current amount of JP of "MEGA" is displayed in the JP amount display section 21 that can be visually recognized from all players playing a game in the satellites 4, the game play wish of other players positioned in the surroundings of the roulette gaming machine 1 as well as the player playing the game is promoted.

Since a JP lottery is held every game, it is made possible to allow the player to always have a sense of anticipation for acquisition of JP. Further, expectation for the remaining JP is not lost still after any JP is paid out, so that the game play wish of the player can be maintained.

It is to be understood that the invention is not limited to the specific embodiment thereof and various improvements, modifications, and changes may be made without departing from the spirit and the scope of the invention, needless to say.

For example, in the embodiment, a gaming machine of the type wherein a large number of players participate in a game is implemented as the roulette gaming machine 1 made up of the main control section 83 for controlling the whole gaming machine of the roulette unit 2, etc., and a plurality of satellites 4 connected to the main control section 83, but may be implemented as a game system 200 made up of a game server 201, a network 203, and a plurality of game terminals 202.

Further, a slot machine may be used in place of the roulette gaming machine.

Figure 25:
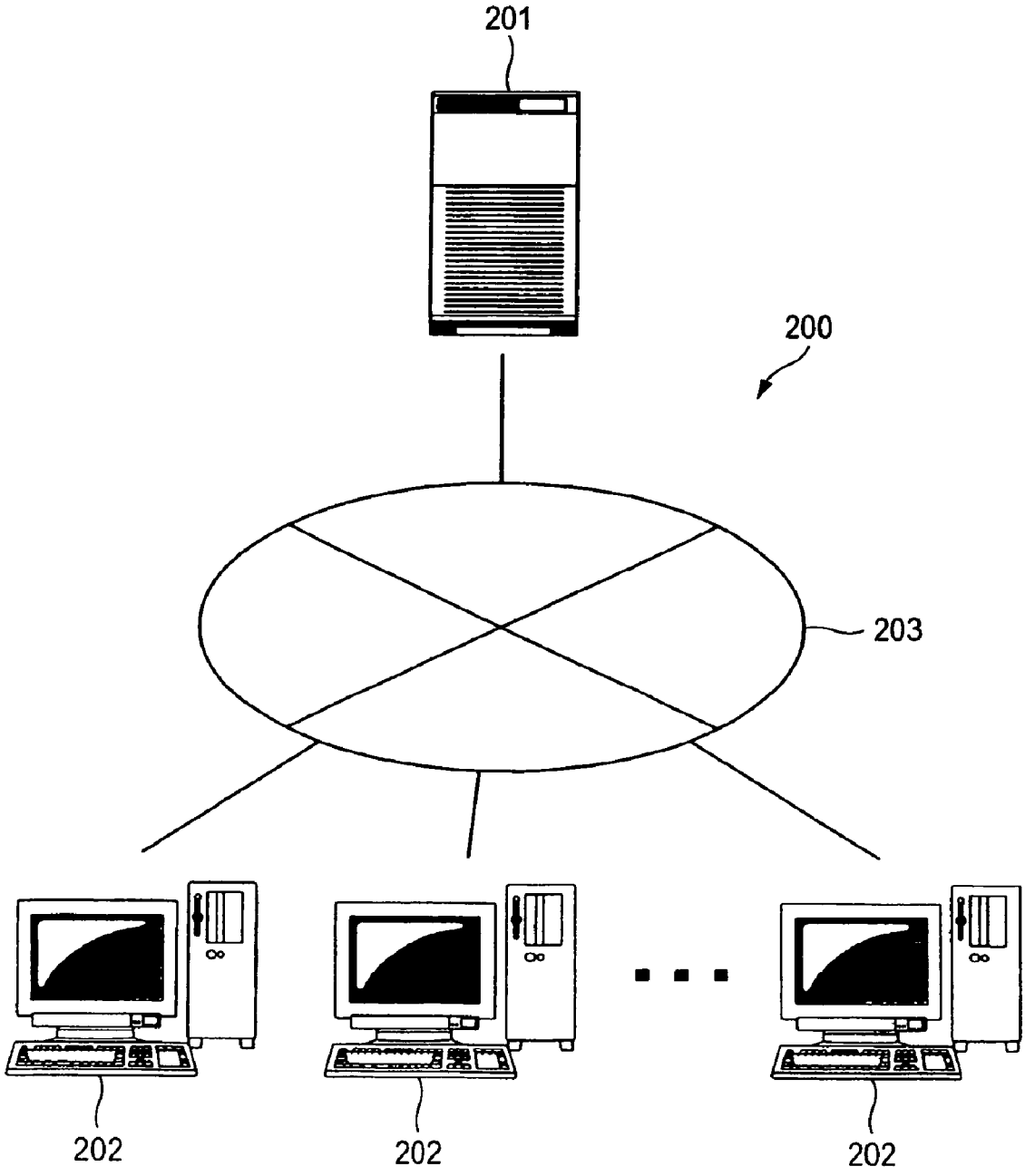
FIG. 25 is a drawing to show a game system according to another embodiment of the invention.

FIG. 25 is a schematic drawing to show the game system 200 according to another embodiment of the invention. In the game system 200 shown in FIG. 25, the processing of the roulette gaming machine 1 described above is distributed to the game server 201 and the game terminals 202 for allowing each player to play a roulette game and a bonus game.

As shown in FIG. 25, the game server 201 and a plurality of game terminals 202, such as PCs, are connected to the network 203 so that they can communicate with each other through the network 203. Each of the game server 201 and the game terminals 202 has a control section made up of a CPU, etc., and a storage section for storing executed programs, etc., and the control section executes various types of processing in accordance with the stored programs.

Specifically, the game terminal 202 executes S1 to S17 shown in FIGS. 13 and 14 and the game server 201 executes S101 to S116. Accordingly, it is made possible to construct one game system.

In the embodiment, the symbols 61 displayed when cocktails are selected and the win description are determined based on the bonus lottery pattern table 50 as the lottery processing at S108 is performed, but only the symbols displayed corresponding to the first cocktail 51 to the sixth cocktail 56 may be determined in the lottery processing at S108 and the win description may be determined based on the cocktail selection result of the player.

In the embodiment, if the player wins "rank-up JP," rank up (change) from JP of "MINI" to JP of "MEGA" occurs if the award of the roulette game is 200 credit points or more. However, rank up (change) from JP of "MINI" to JP of "MAJOR" may occur, for example, if the award is 100 credit points or more.

In the embodiment, a bonus game is generated at the satellite 4 where the lottery result is the lottery result of generating a bonus game provided that the player bets 50 chips or more on a roulette game. However, the number of bet chips may be any other value than 50; for example, the number of bet chips may be one or more.

In the embodiment, a lottery as to whether or not a bonus game is to be generated is first held and then whether or not the player bets 50 chips or more on a roulette game is determined. However, first whether or not the player bets 50 chips or more on a roulette game may be determined and then a lottery as to whether or not a bonus game is to be generated may be held only at the satellite where the player bets 50 chips or more.

In the embodiment, whether or not a bonus game is to be generated and the win description of the bonus game (for example, win of JP of "MINI" or the like) are determined at the same time based on one bonus lottery pattern table 50. However, first only a lottery as to whether or not a bonus game is to be generated may be held and only if it is determined that a bonus game is to be generated as a result of the lottery, another lottery for determining the win description of the bonus game may be held.

The bonus game lottery processing may be performed by the satellite control CPU 91 for each satellite 4 without being performed for all satellites 4 by the main control CPU 80 in batch.

In the embodiment, the game medium is a medal. However, a coin, a hard currency, a paper currency, a token, a card and a ticket may be used as a game medium.

In the gaming machine according to the embodiment, the lottery result of the second lottery unit is displayed on the image display unit based on predetermined operation performed by the player in the bonus game, so that the player does not get tired of playing a game because of various games with the lottery result displayed based on the predetermined operation.

In the gaming machine according to the embodiment, the game medium of the cumulative predetermined value cumulatively stored in the cumulative storage unit based on the lottery result of the second lottery unit are paid out to the game terminal determined to satisfy the predetermined condition. Thus, for example, if a large number of game terminals are included, it is made possible to control the presence or absence of payout of jackpot based on the predetermined operation.

In the gaming machine according to the embodiment, if it is determined that a player plays a game at the game terminal, the game medium of the cumulative predetermined value cumulatively stored in the cumulative storage unit based on the lottery result of the second lottery unit are paid out to the game terminal. Thus, if a large number of game terminals are included, it is not feared that a jackpot may be paid out at the game terminal where no player plays a game.

In the gaming machine according to the embodiment, if it is determined that the game medium of the predetermined value or more are accepted at the game terminal, the game medium of the cumulative predetermined value cumulatively stored in the cumulative storage unit based on the lottery result of the second lottery unit are paid out to the game terminal. Thus, if a large number of game terminals are included, it is not feared that a jackpot may be paid out at the game terminal where no player plays a game. It is made possible to detect the game terminal where a player plays a game and it is also made possible to allow the player to use a larger number of game medium and promote the game play wish of the player.

In the gaming machine according to the embodiment, the plurality of cumulative storage units are different in the ratio of a predetermined value of game medium stored for the value of the game medium accepted by the acceptance unit, so that a sense of anticipation of the player for the game result concerning acquisition of a jackpot can be more promoted and the game play wish of the player can be maintained regardless of win of a jackpot. Therefore, it is made possible to allow the player to continue to play a game.

Further, in the gaming machine according to the embodiment, the game medium display unit for displaying the value of the game medium stored in the cumulative storage unit assigned the highest ratio of the game medium stored for the game medium accepted by the acceptance unit is provided at a position where the display can be visually recognized from all players playing a game at the plurality of game terminals. Thus, it is made possible to promote the sense of anticipation of the player for winning the jackpot for enabling the player to acquire as many game medium as the largest number and it is made possible to provide various games. The game play wish of a person who does not play a game although he or she is in the surrounding of the gaming machine is also promoted.

What is claimed is:

1. A gaming machine of the type wherein a large number of players participate in a game, the gaming machine comprising:

a plurality of game terminals each including an operation section accepting operation of a player, an acceptance unit accepting game medium, and an image display unit displaying a predetermined image;

a plurality of cumulative storage units each cumulatively storing a predetermined value of the game medium out of a value of the medium accepted by the acceptance unit and further cumulatively storing different ratios of the predetermined values of the medium to the values of the game medium accepted by the acceptance unit;

a game control unit controlling a game based on a base game or a bonus game having a different game mode from the base game;

a first lottery unit performing a lottery as to whether or not the bonus game is generated for each of the plurality of game terminals;

a second lottery unit performing a lottery as to whether or not game medium of the cumulative predetermined value stored in any of the plurality of cumulative storage units are paid out for each game terminal when the bonus game is generated according to the lottery result of the first lottery unit; and a cumulative game medium paying configured to pay out the game medium of the cumulative predetermined value cumulatively stored in a first cumulative storage unit determined based on the lottery result of the second lottery unit to the determined game terminal as a first payout according to the lottery result of the second lottery unit and a condition that a predetermined award of the base game is not exceeded in the base game result, and the cumulative game medium payout unit further paying out the game medium of the cumulative higher predetermined value cumulatively stored in a second cumulative storage unit determined based on the lottery result of the second lottery unit to the determined game terminal as a second payout according to the second lottery result and a condition that the predetermined award of the base game is exceeded in the base game result.

2. The gaming machine according to claim 1, wherein the lottery result of the second lottery unit is displayed on the image display unit based on predetermined operation of the operation section, as the bonus game.

3. The gaming machine according to claim 1, further comprising:

a condition determination unit determining whether or not the game terminal satisfies a predetermined condition, wherein the cumulative game medium payout unit pays out the game medium of the cumulative predetermined value cumulatively stored in the cumulative storage unit based on the lottery result of the second lottery unit to the game terminal determined to satisfy the predetermined condition by the condition determination unit.

4. The gaming machine according to claim 3, further comprising:

a player detection unit detecting whether or not a player plays a game at the game terminal, wherein the condition determination unit determines whether or not the game terminal satisfies a condition that a player should play a game at the game terminal based on the detection result of the player detection unit.

5. The gaming machine according to claim 3, further comprising:

a acceptance detection unit detecting whether or not the game medium is accepted by the acceptance unit at the game terminal, wherein the condition determination unit determines whether or not the game terminal satisfies a condition that the game medium of a predetermined value or more should be accepted at the game terminal based on the detection result of the acceptance detection unit.

6. The gaming machine according to claim 1, further comprising:

a game medium display unit displaying the value of the game medium stored in a cumulative storage unit assigned the highest ratio of the predetermined value of game medium stored to the value of the game medium accepted by the acceptance unit among the plurality of cumulative storage units, wherein the game medium display unit is provided at a position where the display can be visually recognized from all players playing a game at the plurality of game terminals.

7. The gaming machine according to claim 1, wherein the image display unit includes a BET screen that displays cumulative predetermined values stored in the plurality of cumulative storage units.

8. The gaming machine according to claim 7, wherein the cumulative predetermined values respectively includes an initial value.

9. The gaming machine according to claim 1, wherein the gaming machine is a roulette gaming machine.

10. The gaming machine according to claim 1, wherein said first lottery unit cancels generation of a bonus game if the lottery indicates that a bonus game should be generated and a predetermined number of bet chips on the base game is not exceeded in the base game betting.

* * * * *